US010529277B2

(12) United States Patent
Lee et al.

(10) Patent No.: US 10,529,277 B2
(45) Date of Patent: Jan. 7, 2020

(54) ELECTROLUMINESCENCE DISPLAY

(71) Applicant: LG Display Co., Ltd., Seoul (KR)

(72) Inventors: Sohyung Lee, Paju-si (KR); Namyong Gong, Paju-si (KR); Sungsoo Shin, Paju-si (KR); Jungyul Yang, Paju-si (KR); Heesung Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/991,045

(22) Filed: May 29, 2018

(65) Prior Publication Data

US 2018/0350286 A1 Dec. 6, 2018

(30) Foreign Application Priority Data

May 31, 2017 (KR) ..... 10-2017-0067705

(51) Int. Cl.
*G09G 3/3225* (2016.01)

(52) U.S. Cl.
CPC ... *G09G 3/3225* (2013.01); *G09G 2300/0426* (2013.01); *G09G 2300/0439* (2013.01); *G09G 2320/0257* (2013.01); *G09G 2320/043* (2013.01); *G09G 2320/045* (2013.01); *G09G 2330/023* (2013.01)

(58) Field of Classification Search
CPC .. G09G 3/32–3/3291; G09G 2320/043; G09G 2320/045; G09G 2320/0257
See application file for complete search history.

(56) References Cited

U.S. PATENT DOCUMENTS 8,040,299 B2 * 10/2011 Kretz ..... G09G 3/3233 313/463
9,437,135 B2 * 9/2016 Kim ..... G09G 3/3233
10,339,865 B2 * 7/2019 Chen ..... G09G 3/3266
(Continued)

FOREIGN PATENT DOCUMENTS

JP 2001284597 A 10/2001
JP 2002280558 A 9/2002
(Continued)

OTHER PUBLICATIONS

Office Action dated May 21, 2019 issued in the corresponding Japanese Application No. 2018-093529, 5 Pages.

*Primary Examiner* — Gene W Lee
(74) *Attorney, Agent, or Firm* — Polsinelli PC

(57) ABSTRACT

An electroluminescence display is provided. The electroluminescence display comprises data lines and gate lines intersecting each other and pixels arranged in a matrix, wherein each of subpixels of each pixel comprises: a first driver configured to drive a light-emitting element by using a first EM switching element, which switches the current path between a power supply line to which a pixel driving voltage is applied and the light-emitting element in response to a first light-emission control signal, and a first driving element connected between the first EM switching element and the light-emitting element; and a second driver configured to drive the light-emitting element by using a second EM switching element, which switches the current path between the power supply line and the light-emitting element in response to a second light-emission control signal, and a second driving element connected between the second EM switching element and the light-emitting element.

18 Claims, 36 Drawing Sheets

(56) References Cited

U.S. PATENT DOCUMENTS

| | | | | |
|---|---|---|---|---|
| 2010/0194450 | A1* | 8/2010 | Shimizu | G09G 3/3233 327/109 |
| 2015/0008405 | A1* | 1/2015 | Kim | G09G 3/3233 257/40 |
| 2015/0243683 | A1 | 8/2015 | Lee et al. | |
| 2015/0243688 | A1 | 8/2015 | Lee et al. | |
| 2015/0243689 | A1 | 8/2015 | Lee et al. | |
| 2015/0243724 | A1 | 8/2015 | Cho et al. | |
| 2016/0353038 | A1* | 12/2016 | Madurawe | H01L 29/42384 |
| 2016/0365370 | A1* | 12/2016 | Ellinger | H01L 27/1251 |
| 2017/0092178 | A1 | 3/2017 | Lee et al. | |
| 2017/0110056 | A1* | 4/2017 | Hu | G09G 3/3258 |
| 2017/0186782 | A1* | 6/2017 | Lee | H01L 27/1251 |
| 2018/0158845 | A1* | 6/2018 | Liao | H01L 27/1251 |
| 2018/0315376 | A1* | 11/2018 | Chen | G09G 3/3258 |

FOREIGN PATENT DOCUMENTS

| | | | |
|---|---|---|---|
| JP | 2004054200 | A | 2/2004 |
| JP | 2004341314 | A | 12/2004 |
| JP | 2009128503 | A | 6/2009 |
| JP | 2015188059 | A | 10/2015 |
| JP | 2017038048 | A | 10/2015 |
| KR | 10-2009-0090933 | A | 8/2009 |
| KR | 20150100459 | A | 9/2015 |

* cited by examiner

ELECTROLUMINESCENCE DISPLAY

CROSS-REFERENCE TO RELATED APPLICATION

This application claims the benefit of Korean Patent Application No. 10-2017-0067705 filed on May 31, 2017, the entire contents of which is incorporated herein by reference for all purposes as if fully set forth herein.

BACKGROUND

Field of the Disclosure

The present disclosure relates to an electroluminescence display in which two driving elements are connected to a single light-emitting element.

Description of the Background

Flat panel displays include liquid crystal displays (LCD), electroluminescence displays, field emission displays (FED), and plasma display panels (PDP).

Electroluminescence displays can be classified into inorganic light-emitting displays and organic light-emitting displays depending on the material of an emission layer. Of these, an active-matrix organic light emitting display comprises organic light-emitting diodes (hereinafter, "OLED") which emit light themselves, and has the advantages of fast response time, high luminous efficiency, high brightness, and wide viewing angle.

An OLED of an organic light-emitting display comprises an anode, a cathode, and an organic compound layer disposed between these electrodes. The organic compound layer consists of a hole injection layer (HIL), a hole transport layer (HTL), an emission layer (EML), an electron transport layer (ETL), and an electron injection layer (EIL). When a power voltage is applied to the anode and cathode, a hole passing through the hole transport layer HTL and an electron passing through the electron transport layer ETL move to the emission layer EML, forming an exciton. As a result, the emission layer EML generates visible light.

To compensate for variation in the electrical characteristics of a driving element, internal compensation and external compensation may be applied. In the internal compensation method, variation in the electrical characteristics of the driving element between pixels is automatically compensated for in real time by using the gate-source voltage of the driving element which varies with the electrical characteristics of the driving element. In the external compensation method, variation in the electrical characteristics of the driving element between pixels is compensated for by sensing the voltage of each pixel varying with the electrical characteristics of the driving element and modulating data of an input image by an external circuit based on the sensed voltage.

Each pixel of an organic light-emitting display comprises a driving element for controlling the current flowing through the OLED in accordance with pixel data of an input image. The driving element can be implemented as a transistor. The electrical characteristics of the driving element, such as threshold voltage and mobility, should be the same across all pixels, but may not be uniform due to the process conditions, operating environment, etc. The driving element is subjected to more stress as operating time increases. The stress on the driving element varies with pixel data of an input image. As the stress on the driving element increases, the driving element deteriorates more quickly. The threshold voltage of the driving elements is shifted due to cumulative stress on the driving elements of the pixels, which, as a result, may create a ghost image even after the image on the screen is changed.

SUMMARY

The present disclosure provides an electroluminescence display that prevents a ghost image caused by cumulative stress on driving elements and reduces power consumption.

An electroluminescence display according to the present disclosure comprises data lines and gate lines intersecting each other and pixels arranged in a matrix form.

Each of subpixels of each pixel comprises: a first driver configured to drive a light-emitting element by using a first EM switching element, which switches the current path between a power supply line to which a pixel driving voltage is applied and the light-emitting element in response to a first light-emission control signal, and a first driving element connected between the first EM switching element and the light-emitting element; and a second driver configured to drive the light-emitting element by using a second EM switching element, which switches the current path between the power supply line and the light-emitting element in response to a second light-emission control signal, and a second driving element connected between the second EM switching element and the light-emitting element.

BRIEF DESCRIPTION OF THE DRAWINGS

The accompanying drawings, which are included to provide a further understanding of the disclosure and are incorporated in and constitute a part of this application, illustrate aspects of the disclosure and together with the description serve to explain the principles of the disclosure.

In the drawings.

DETAILED DESCRIPTION

Figure 1:
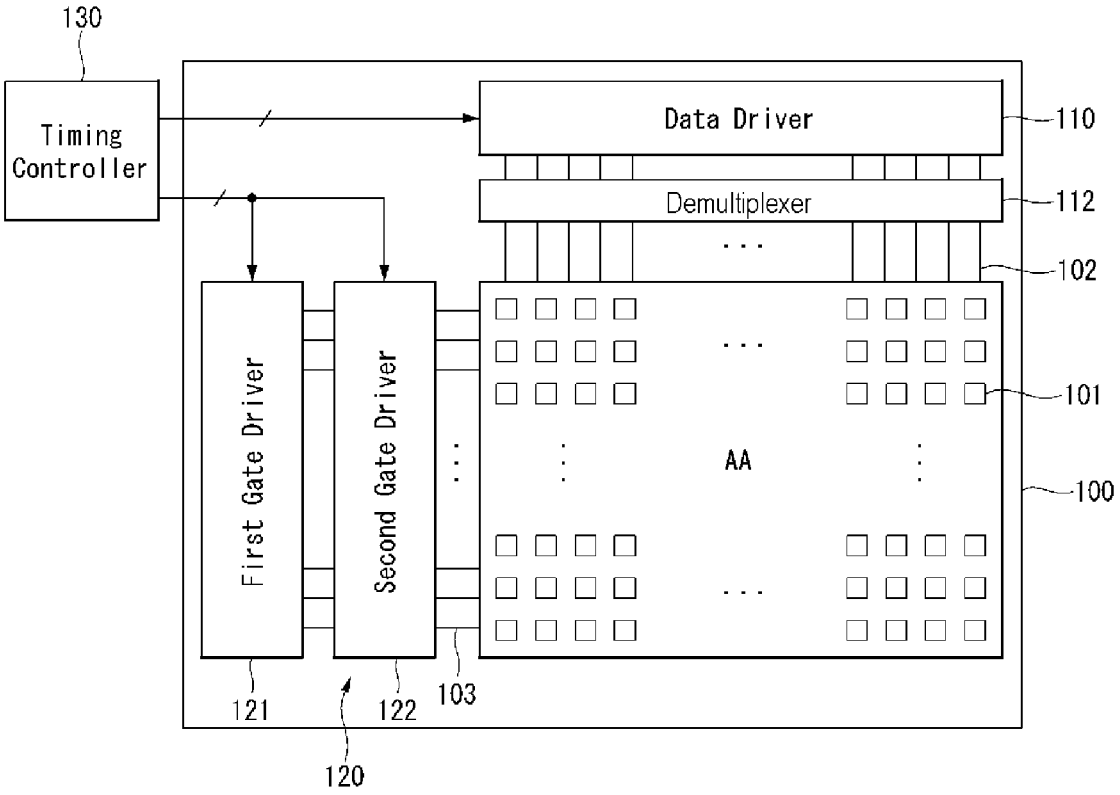
FIG. 1 is a block diagram showing an electroluminescence display according to an exemplary aspect of the present disclosure.

Various aspects and features of the present disclosure and methods of accomplishing them may be understood more readily by reference to the following detailed descriptions of exemplary aspects and the accompanying drawings. The present disclosure may, however, be embodied in many different forms and should not be construed as being limited to the exemplary aspects set forth herein. Rather, these exemplary aspects are provided so that this disclosure will be thorough and complete and will fully convey the concept of the present disclosure to those skilled in the art, and the present disclosure is defined by the appended claims.

The shapes, sizes, proportions, angles, numbers, etc. shown in the figures to describe the exemplary aspects of the present disclosure are merely examples and not limited to those shown in the figures. Like reference numerals denote like elements throughout the specification. In describing the present disclosure, detailed descriptions of related well-known technologies will be omitted to avoid unnecessary obscuring the present disclosure.

When the terms 'comprise', 'have', 'consist of' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms "on", "over", "under", "next to" and the like, one or more parts may be positioned between the two parts as long as the term 'immediately' or 'directly' is not used.

It will be understood that, although the terms first, second, etc., may be used to distinguish one element from another element, the functions or structures of these elements should not be limited by these terms. For example, the ordinal numbers such as first, second, third, and fourth used to label the elements in the pixel circuit of FIG. 4 are used to describe the order in which data lines are charged through switching elements S1 to S4.

The following exemplary aspects of the present disclosure may be coupled or combined with one another either partly or wholly, and may technically interact or work together in various ways. The exemplary aspects may be carried out independently or in connection with one another.

An electroluminescence display according to the present disclosure may comprise either an N-type TFT (NMOS) or a p-type TFT (PMOS) or both of them. A TFT is a three-electrode device with gate, source, and drain. The source is an electrode that provides carriers to the transistor. The carriers in the TFT flow from the source. The drain is an electrode where the carriers leave the transistor. In the TFT, carriers flow from the source to the drain. In the case of an n-type TFT, the carriers are electrons, and thus the source voltage is lower than the drain voltage so that the electrons flow from the source to the drain. In the n-type TFT, current flows from the drain to the source. In the case of a p-type TFT, the carriers are holes, and thus the source voltage is higher than the drain voltage so that the holes flow from the source to the drain. In the p-type TFT, since the holes flow from the source to the drain, current flows from the source to the drain. It should be noted that the source and drain of a TFT are not fixed in position. For example, the source and drain of the TFT are interchangeable depending on the applied voltage. Accordingly, the present disclosure is not limited by the source and drain of the TFT. In the description below, the source and drain of the TFT are termed first and second electrodes.

Gate signals for TFTs used as switching elements swing between a gate-on voltage and a gate-off voltage. The gate-on voltage is set to a voltage higher than the threshold voltage of the TFTs, and the gate-off voltage is set to a voltage lower than the threshold voltage of the TFTs. The TFTs turn on in response to the gate-on voltage and turn off in response to the gate-off voltage. In NMOS, the gate-on voltage may be a gate-high voltage VGH, and the gate-off voltage may be a gate-low voltage VGL. In PMOS, the gate-on voltage may be a gate-low voltage VGL, and the gate-off voltage may be a gate-high voltage VGH.

Hereinafter, various exemplary aspects of the present disclosure will be described in detail with reference to the accompanying drawings. In the exemplary aspects below, the description of the electroluminescence display will focus on an organic light-emitting display comprising organic light-emitting material. The technical idea of the present disclosure is not limited to organic light-emitting displays but may apply to inorganic light-emitting displays comprising inorganic light-emitting material.

In the present disclosure, a compensation circuit for compensating for degradation of driving elements is used in a pixel circuit, in order to improve the picture quality and lifetime of the electroluminescent display. That is, internal compensation circuits in subpixels are used when driving the pixels, in order to compensate for variation in threshold voltage between the driving elements in real time within the pixel circuits by sampling the threshold voltage of the driving elements and offsetting data voltages of an input image by the threshold voltage. Also, in the present disclosure, two driving elements are connected to a single light-emitting element in a pixel circuit, and the driving elements are operated alternately, which slows down the accumulation of stress on the driving elements and reduces degradation of the driving elements, thereby preventing ghost images.

Referring to FIG. 1, an electroluminescence display according to an exemplary aspect of the present disclosure comprises a display panel 100 and a display panel drive circuit.

The display panel 100 comprises an active area AA that displays input images on the screen. A pixel array is arranged in the active area AA. The pixel array comprises a plurality of data lines 102, a plurality of gate lines 103 intersecting the data lines 102, and a plurality of pixels arranged in a matrix form.

Each display pixel may be divided into a red subpixel, a green subpixel, and a blue subpixel to represent colors. Each pixel may further comprise a white subpixel. Each subpixel 101 comprises a pixel circuit. As exemplified in FIGS. 2 and 14, the pixel circuit comprises first and second driving elements DT1 and DT2 connected to a single light-emitting element EL, a plurality of switching elements S1 to S34, and a capacitor Cgs. The driving elements and the switching elements may be implemented as NMOS or PMOS TFTs. It should be noted that the pixel circuit is not limited to those of FIGS. 2 and 14. Although FIGS. 2 and 14 exemplify an MMOS pixel circuit, the driving elements and switching elements of the pixel circuit may be implemented as PMOS. The pixel circuit is connected to a data line 102 and a gate line 103.

Figure 2:
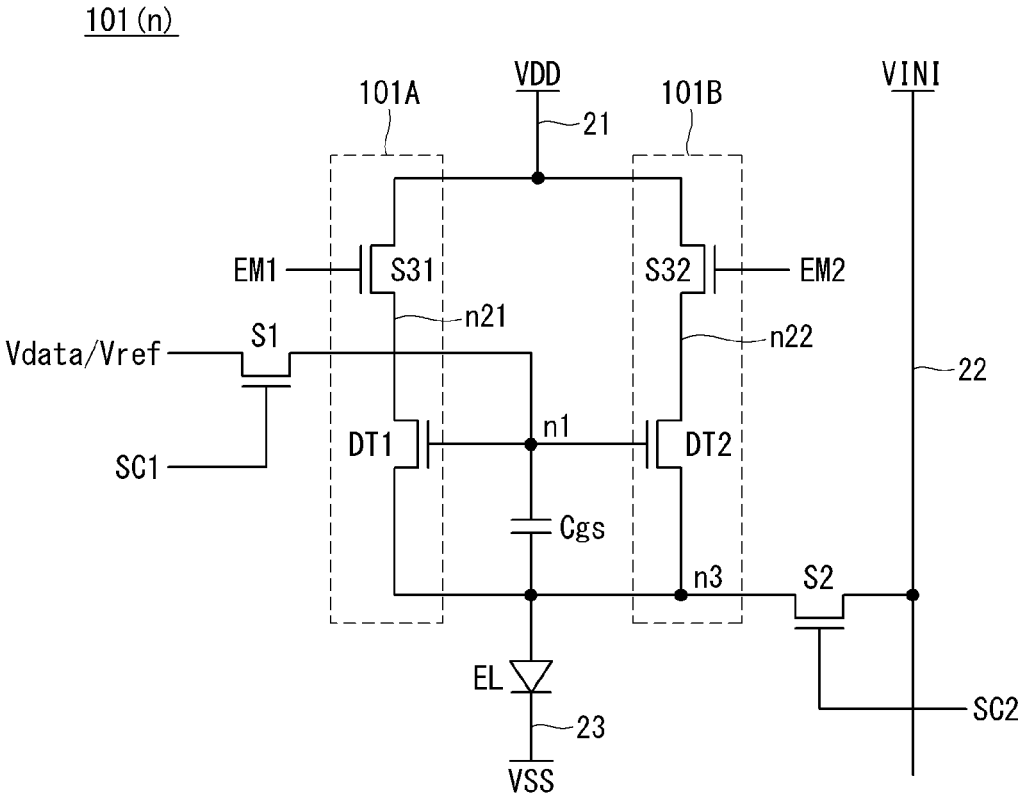
FIG. 2 is a circuit diagram showing a pixel circuit according to a first exemplary aspect of the present disclosure.
Figure 14:
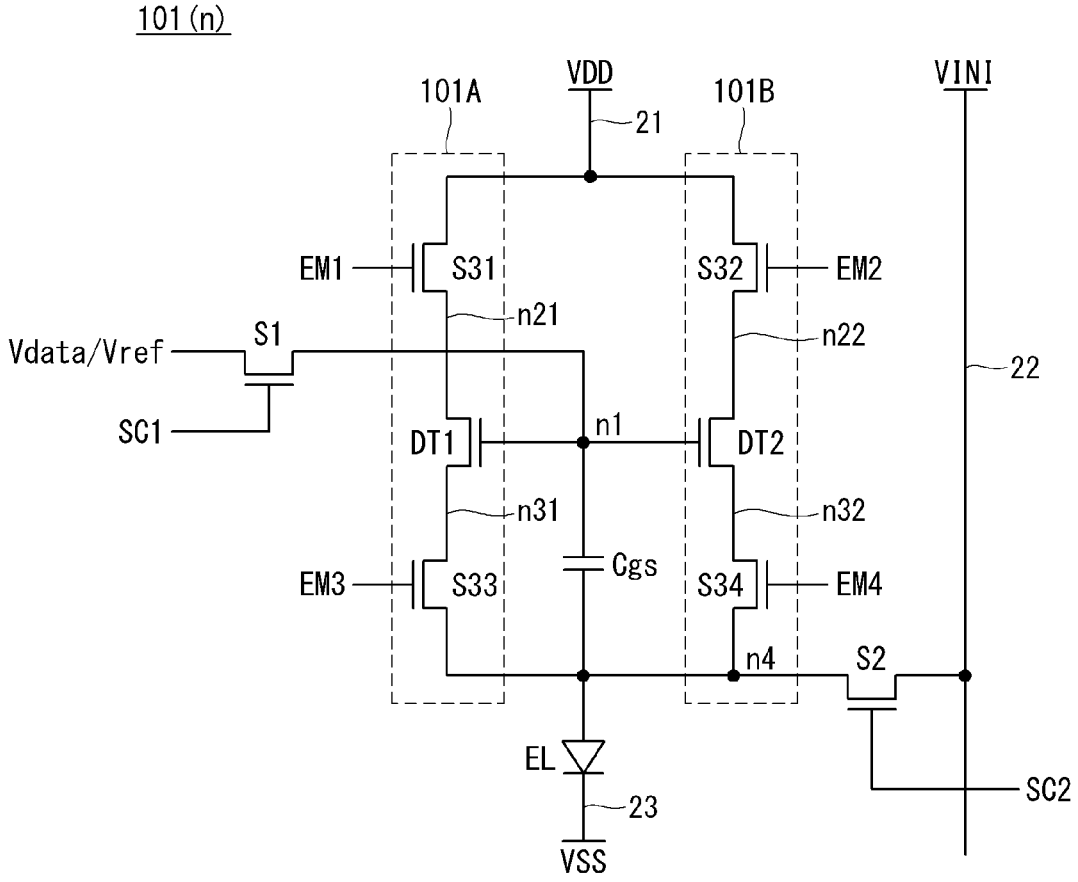
FIG. 14 is a circuit diagram showing a pixel circuit according to a second exemplary aspect of the present disclosure.

As shown in FIGS. 2 and 14, the display panel 100 may further comprise a first power supply line 21 for supplying a pixel driving voltage or high-level driving voltage VDD to the subpixels 101, a second power supply line 22 for supplying a predetermined initial voltage VINI to the subpixels 101 to reset the pixel circuit, and a VSS electrode for supplying a low-level power supply voltage VSS to the pixels. The power supply lines and the VSS electrode are connected to a power circuit (not shown).

Touch sensors may be placed on the display panel 100. Touch input may be sensed using touch sensors or through pixels. The touch sensors may be implemented as on-cell type- or add-on type touch sensors which are placed on the screen of the display panel, or as in-cell type touch sensors embedded in the pixel array.

The display panel drive circuit comprises a data driver 110 and a gate driver 120. A demultiplexer 112 may be placed between the data driver 110 and the data lines 102.

The display panel drive circuits 110, 112, and 120 write data of an input image to the pixels of the display panel 100 under control of a timing controller (TCON) 130. The display panel drive circuit may further comprise a touch sensor driver for driving the touch sensors. The touch sensor driver is omitted in FIG. 1. In a mobile device or wearable device, the data driver, the timing controller 130, and the power circuit may be integrated in one integrated circuit.

The data driver 110 converts digital data of an input image, received from the timing controller 130 in each frame, to gamma-compensated voltages to produce data voltages. The data driver 110 outputs voltages of data signals (hereinafter, referred to as "data voltages") through output buffers of individual channels. The demultiplexer 112 is placed between the data driver 110 and the data lines 102 and distributes the data voltages output from the data driver 110 to the data lines 102 using a plurality of switching elements. Because of the demultiplexer 112, one channel of the data driver 110 is time-divided and connected to multiple data lines, thereby reducing the number of data lines 102.

The gate driver 120 may be implemented as a GIP (Gate in Panel) circuit, formed directly in a bezel area on the display panel 100, along with a TFT array in the active area. The gate driver 120 outputs gate signals to the gate lines 103 under control of the timing controller 130. The gate driver 120 may sequentially supply the gate signals to the gate lines 103 by shifting these signals by a shift register. The gate signals comprise scan signals SC1 and SC2 and light-emission control signals (hereinafter, referred to as "EM signals").

The gate driver 120 may comprise a first gate driver 121 and a second gate driver 122. The first gate driver 121 outputs scan signals SC1 and SC2, and sequentially shifts the scan signals SC1 and SC2 in sync with a shift clock. The second gate driver 122 outputs EM signals EM, and sequentially shifts the EM signals EM in sync with a shift clock. In the case of bezel-less models, the switching elements constituting the first and second gate drivers 121 and 122 may be placed in a distributed manner in the active area AA.

The timing controller 130 receives digital video data DATA of an input image from a host system (not shown) and timing signals synchronized with the digital video data DATA. The timing signals comprise a vertical synchronization signal Vsync, a horizontal synchronization signal Hsync, a dot clock signal DCLK, and a data enable signal DE. The host system may be any one of the following: a television system, a set-top box, a navigation system, a DVD player, a Blue-ray player, a personal computer PC, a home theater system, and a phone system.

In normal driving mode, the timing controller 130 may control frame rate to be higher than input frame frequency. For example, the timing controller 130 may control the operation timing of the display panel drivers 110, 112, and 120 by multiplying the input frame frequency (Hz) by i times (i is a positive integer greater than 0). The frame frequency is 60 Hz in the NTSC (National Television Standards Committee) system and 50 Hz in the PAL (Phase-Alternating Line) system. In low power consumption driving mode, the timing controller 130 may decrease the frame frequency to a frequency of 1 to 30 Hz in order to reduce the refresh rate of the pixels.

The timing controller 130 generates a data timing control signal for controlling the operation timing of the data driver 110, a switch control signal for controlling the operation timing of the demultiplexer 112, and a gate timing control signal for controlling the operation timing of the gate driver 120, based on the timing signals Vsync, Hsync, and DE received from the host system. The voltage level of the gate timing control signal output from the timing controller 130 may be converted to gate-on voltage or gate-off voltage through a level shifter (not shown) and supplied to the gate driver 120. The level shifter converts the low-level voltage of the gate timing control signal to a gate-low voltage VGL and converts the high-level voltage of the gate timing control signal to a gate-high voltage VGH.

FIG. 2 is a circuit diagram showing a pixel circuit according to a first exemplary aspect. FIGS. 3A to 3D and FIGS. 4A to 4D are schematic views showing input signals for the pixel circuit of FIG. 2. This pixel circuit may comprise an internal compensation circuit using a plurality of switching elements.

Referring to FIG. 2, the pixel circuit comprises first and second driving elements DT1 and DT2 connected to a single light-emitting element EL, first to (3-2)th switching elements S1 to S32, and a storage capacitor Cgs. A pixel driving voltage VDD is supplied to subpixels 101(*n*) via the first power supply line 21.

When a voltage higher than 0 V is applied to the gates of the driving elements DT1 and DT2 and a current is produced between the drain and source of the driving elements DT1 and DT2, the stress on the driving TFTs DT1 and DT2 increases, thus degrading the driving TFTs DT1 and DT2. Also, when semiconductor channels of the driving TFTs DT1 and DT2 are illuminated, a current is produced, thus degrading the driving elements DT1 and DT2. The degradation of the driving elements DT1 and DT2 may cause a decrease in the on current flowing while the driving elements DT1 and DT2 are turned on, and a threshold voltage shift. The degradation of the driving elements DT1 and DT2 may lead to variation in the brightness of the light-emitting element EL and ghost images.

The pixel circuit of the disclosure comprises first and second drivers 101A and 101B that are operated alternately. The first driver 101A comprises the (3-1)th switching element S31 and the first driving element DT1, and is operated to supply an electrical current to the light-emitting element EL upon receiving a first EM signal EML The second driver 101B comprises the (3-2)th switching element S32 and the second driving element DT2, and is operated to supply an electrical current to the light-emitting element EL in response to a second EM signal EM2. The (3-1)th switching element S31 of the first driver 101A is turned off during operation of the second driver 101B, and shuts off the current path between the pixel driving voltage VDD and the anode of the light-emitting element EL. While the (3-1)th switching element S31 is turned off, a first electrode of the first driving element DT1 floats and no current flows between the drain and source of the first driving element DT1. The (3-2)th switching element S32 of the second driver 101B is turned off during operation of the first driver 101A, and shuts off the current path between the pixel driving voltage VDD and the anode of the light-emitting element EL. While the (3-2)th switching element S32 is turned off, a first electrode of the second driving element DT2 floats and no current flows between the drain and source of the second driving element DT2.

The present disclosure can reduce cumulative stress on the driving elements DT1 and DT2 and induce the recovery of the driving elements DT1 and DT2 since the first electrodes, i.e., drains, of the driving elements DT1 and DT2 float alternately to shut off the current flowing between the drain and source of the driving elements DT1 and DT2. The present disclosure prevents variation in the brightness of the pixels and ghost images by offsetting data voltages Vdata by variation in the threshold voltage Vth of the driving elements DT1 and DT2 using the internal compensation method of FIGS. 3A to 4D and alternately operating the driving elements DT1 and DT2.

The driving elements DT1 and DT2 and the switching elements S1 to S32 may be implemented as NMOS oxide TFTs with an oxide semiconductor pattern. The oxide TFTs can reduce power consumption because of the small leakage current produced in the off state of the TFTs, and provide higher anti-flicker functionality by preventing a decrease in pixel voltage caused by leakage current.

The light-emitting element EL may be implemented as an OLED. The OLED emits light by the current regulated by the driving elements DT1 and DT2, in response to a data voltage Vdata. The OLED comprises an organic compound layer situated between an anode and a cathode. The organic compound layer may consist of, but is not limited to, a hole injection layer (HIL), a hole transport layer (HTL), an emission layer (EML), an electron transport layer (ETL), and an electron injection layer (EIL). The anode of the OLED is connected to the driving elements DT1 and DT2 via a third node n3, and the cathode of the OLED is connected to a VSS electrode 23 to which the low-level power supply voltage VSS is applied. The storage capacitor Cgs is connected between the gate and source of the driving elements DT1 and DT2 via a first node n1 and the third nodes n3.

In response to a first scan signal SC1, the first switching element S1 supplies a predetermined reference voltage Vref to the first node n1 and then supplies a data voltage Vdata to the first node n1. The reference voltage Vref is set to a voltage that is lower than the pixel driving voltage VDD and resets the voltage of the first node n1. The first switching element S1 comprises a gate connected to a first gate line to which a first scan signal SC1 is applied, a first electrode connected to a data line, and a second electrode connected to the first node n1. The reference voltage Vref and the data voltage Vdata are supplied to the data line.

In response to a second scan signal SC2, the second switching element S2 supplies a predetermined initial voltage VINI to the pixel electrode (or anode) of the light-emitting element EL via the third node n3. The initial voltage VINI is set to a voltage at which the light-emitting element EL emits no light. The initial voltage VINI is lower than the pixel driving voltage VDD. The second switching element S2 comprises a gate connected to a second gate line to which a second scan signal SC2 is applied, a first electrode connected to the second power supply line 22 to which the initial voltage VINI is applied, and a second electrode connected to the third node n3.

In response to a first EM signal EM1, the (3-1)th switching element S31 switches the current path between the first power supply line 21, to which the pixel driving voltage VDD is applied, and the first driving element DT1. The (3-1)th switching element S31 and the (3-2)th switching element S32 are alternately turned on and off. Thus, the (3-1)th switching element S31 is turned on during the off time of the (3-2)th switching element S32 to form a current path between the first power supply line 21 and the first driving element DT1. The (3-1)th switching element S31 comprises a gate connected to a (3-1)th gate line to which the first EM signal EM1 is applied, a first electrode connected to the first power supply line 21 via the (2-1)th node n21, and a second electrode connected to the first electrode of the first driving element DT1 via the (2-1)th node n21.

The first driving element DT1 regulates the current of the light-emitting element EL in response to a gate-source voltage Vgs. The first driving element DT1 and the second driving element DT2 alternately drive the light-emitting element EL. The first driving element DT1 comprises a gate connected to the first node n1, a first electrode connected to the (2-1)th node n21, and a second electrode connected to the third node n3.

In response to a second EM signal EM2, the (3-2)th switching element S32 switches the current path between the first power supply line 21, to which the pixel driving voltage VDD is applied, and the second driving element DT2. The (3-2)th switching element S32 is turned on during the off time of the (3-1)th switching element S31 to form a current path between the first power supply line 21 and the second driving element DT2. The (3-2)th switching element S32 comprises a gate connected to a (3-2)th gate line to which the second EM signal EM2 is applied, a first electrode connected to the first power supply line 21 via a (2-2)th node n22, and a second electrode connected to the first electrode of the second driving element DT2 via the (2-2)th node n22.

The second driving element DT2 regulates the current of the light-emitting element EL in response to a gate-source voltage Vgs. The second driving element DT2 and the first driving element DT1 alternately drive the light-emitting element EL. The second driving element DT2 comprises a gate connected to the first node n1, a first electrode connected to the (2-2)th node n22, and a second electrode connected to the third node n3.

FIGS. 3A to 3D and FIGS. 4A to 4D are schematic views showing how the pixel circuit 101(*n*) of an nth subpixel works. Each pixel circuit is driven by the internal compensation method of FIGS. 3A to 4D to sample the threshold voltage Vth of the driving elements DT1 and DT2 and offset data voltages Vdata by in threshold voltage Vth. The arrows in FIGS. 3A to 3D and FIGS. 4A to 4D indicate the flow of an electric current. FIGS. 3A to 3D show how the light-emitting element EL is driven by the first driver 101A in a step-by-step manner. FIGS. 4A to 4D show how the light-emitting element EL is driven by the second driver 101B in a step-by-step manner.

Figure 3A:
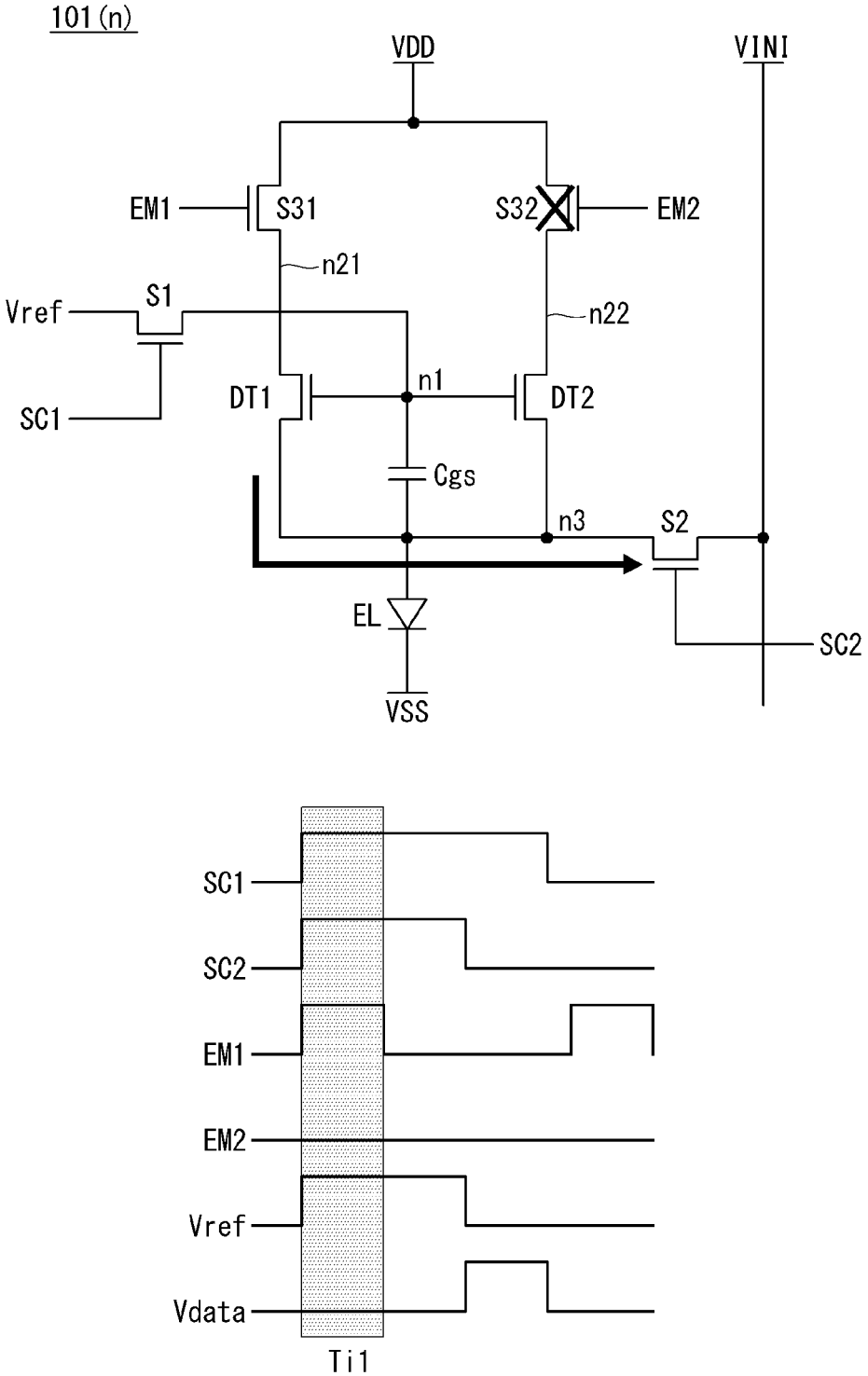
FIGS. 3A to 3D and FIGS. 4A to 4D are schematic views showing how the pixel circuit of FIG. 2 works.

Referring to FIG. 3A, the scan signals SC1 and SC2 and the first EM signal EM1 change into the gate-on voltage when a first reset time Ti1 starts. The second EM signal EM2 is held at the gate-off voltage during operation of the first driver 101A. In NMOS, the gate-on voltage is set to the gate-high voltage VGH, and the gate-off voltage is set to the gate-low voltage VGL. Thus, the switching elements S1, S2, and S31, other than the (3-2)th switching element S32, are turned on during the first reset time Ti1.

During the first reset time Ti1, the reference voltage Vref, set regardless of data voltages Vdata for an input image, is supplied to the data lines 102. During the first reset time Ti1, the first switching element S1 turns on in response to the gate-on voltage of the first scan signal SC1, and the second switching element S2 turns on in response to the gate-on voltage of the second scan signal SC2. The (3-1)th switching element S31 turns on in response to the gate-on voltage of the first EM signal EM1.

The voltage of each node in the pixel circuit is reset during the first reset time Ti1. During the first reset time Ti1, the first node n1 is reset to Vref, the (2-1)th node n21 is reset to VDD, and the third node n3 is reset to VINI.

Figure 3B:
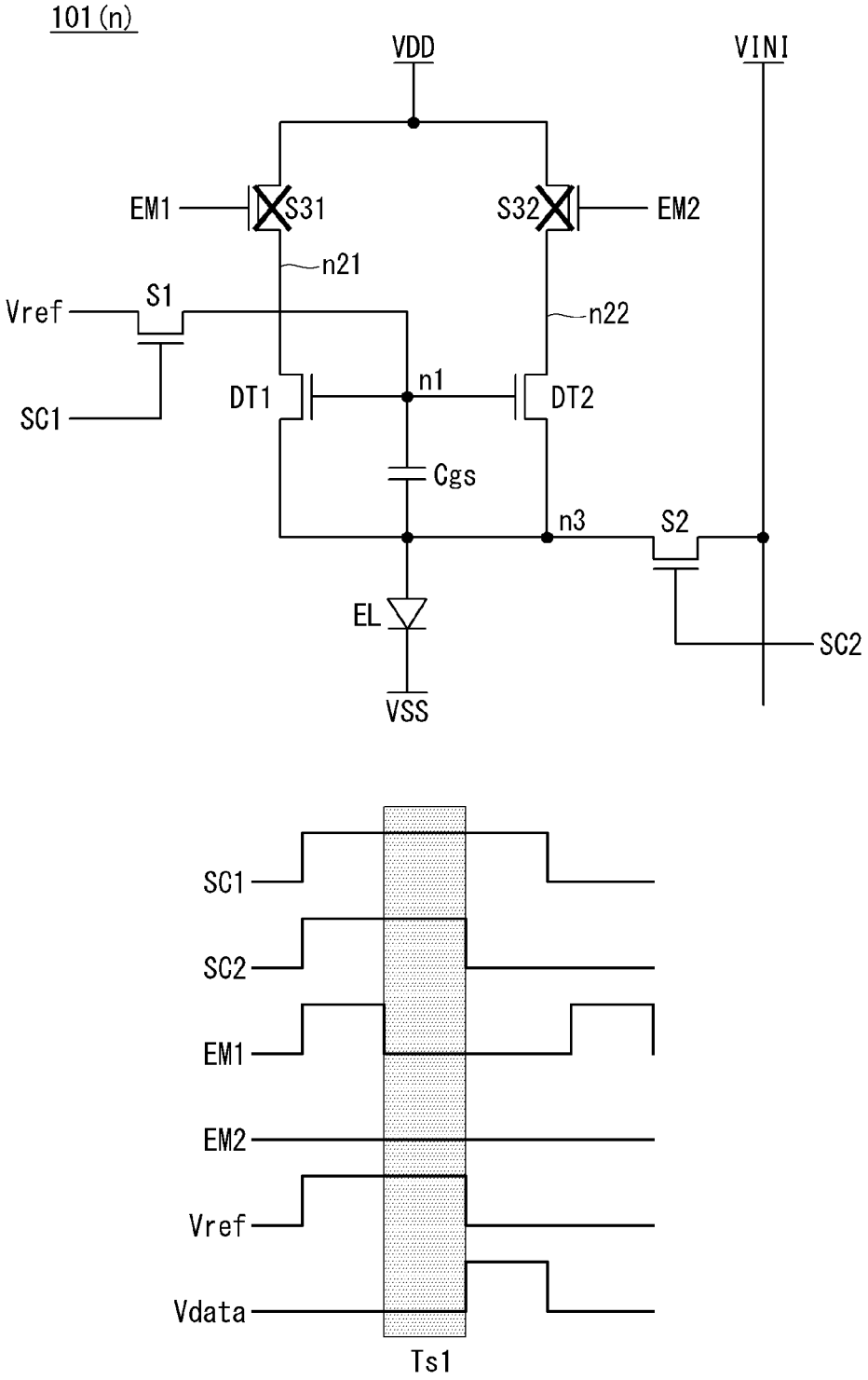

Referring to FIG. 3B, when a first sampling time Ts1 starts, the first EM signal EM1 is inverted to the gate-off voltage to turn off the (3-1)th switching element S31. During the first sampling time Ts1, the first and second scan signals SC1 and SC2 are held at the gate-on voltage, and the second EM signal EM2 is held at the gate-off voltage. Thus, during the first sampling time Ts1, the (3-1)th and (3-2)th switching elements S31 and S32 are turned off, whereas the first and second switching elements S1 and S2 are turned on.

During the first sampling time Ts1, the reference voltage Vref is supplied to the data lines 102, and the voltage of the third node n3 is held at VINI. During the first sampling time Ts1, the gate-source voltage Vgs of the first driving element DT1 becomes higher by the threshold voltage Vth of the first driving element DT1, and this threshold voltage Vth is stored in the storage capacitor Cgs.

Figure 3C:
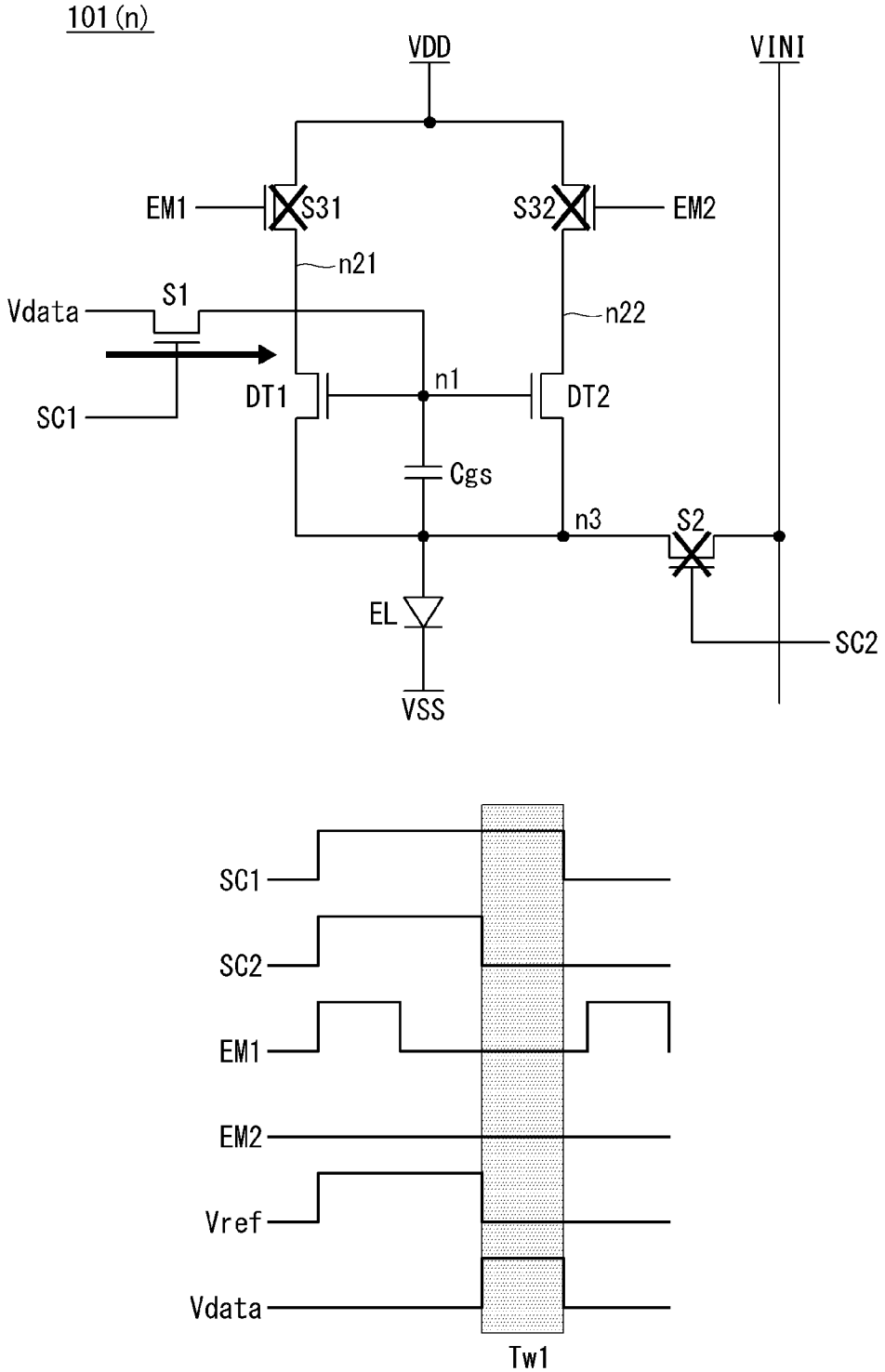

Referring to FIG. 3C, when a first data writing time Tw1 starts, the second scan signal SC2 is inverted to the gate-off voltage. During the first data writing time Tw1, the first scan signals SC1 is held at the gate-on voltage, and the first and second EM signals EM1 and EM2 are held at the gate-off voltage. Thus, during the first data writing time Tw1, the first switching element S1 remains in the on state and supplies a data voltage Vdata to the first node n1, whereas the other switching elements S2, S31, and S32 are turned off.

In the first data writing time Tw1, the gate-source voltage Vgs of the first driving element DT1 changes into a data voltage offset by the threshold voltage Vth of the first driving element DT1.

Figure 3D:
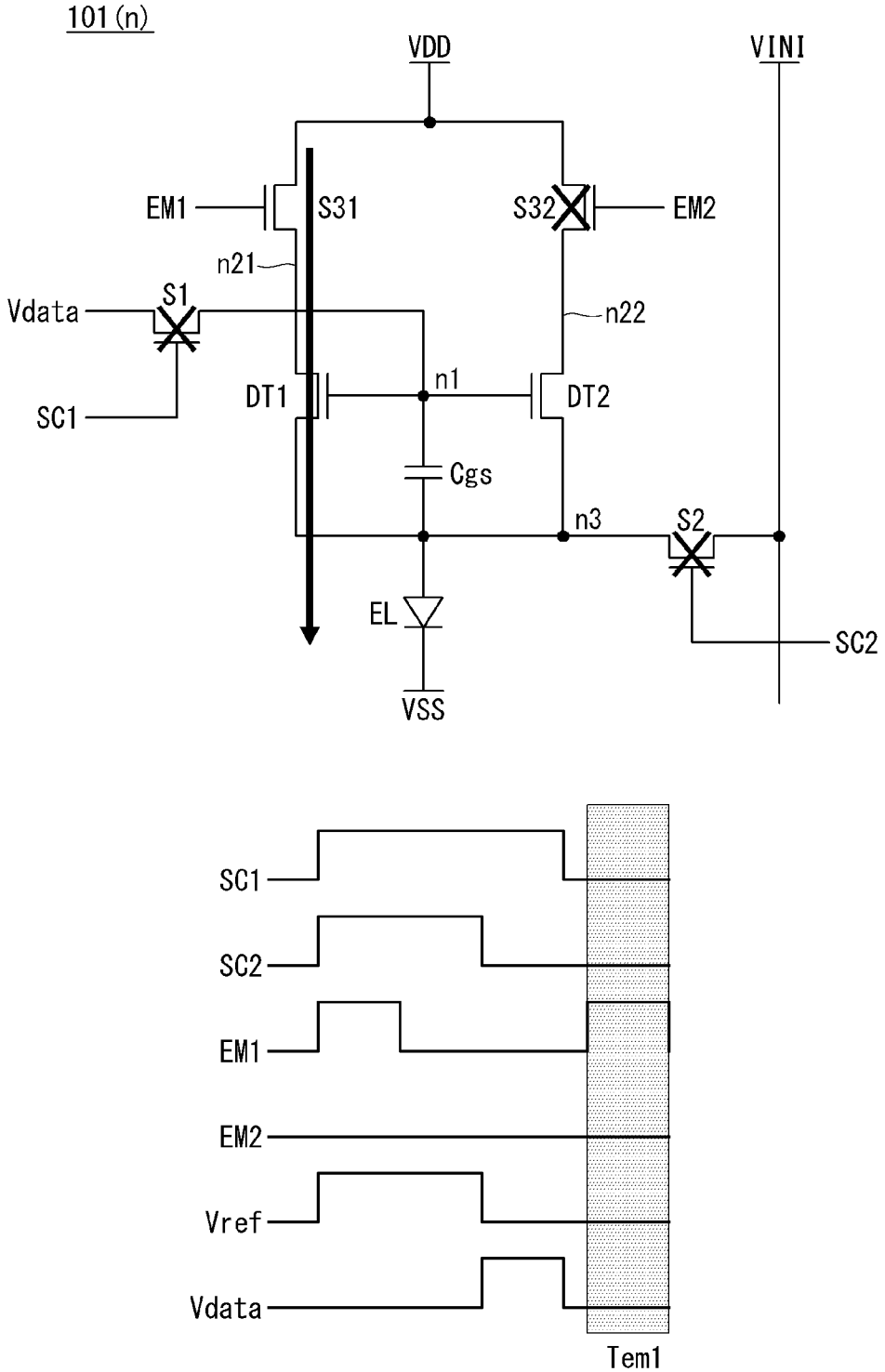

Referring to FIG. 3D, when a first emission time Tem1 starts, the first scan signal SC1 is inverted to the gate-off voltage, and the first EM signal EM1 is inverted to the gate-on voltage. During the first emission time Tem1, the second scan signal SC2 is held at the gate-off voltage, and the second EM signal EM2 is held at the gate-off voltage. Thus, during the first emission time Tem1, the (3-1)th switching element S31 is turned on, whereas the other switching elements S1, S2, and S32 are turned off.

During the first emission time Tem1, current flows in the light-emitting element EL in response to the gate-source voltage Vgs of the first driving element DT1, thereby causing the light-emitting element EL to emit light. During the first emission time Tem1, the first EM signal EM1 may be generated as an alternating current signal that swings between the gate-on voltage and the gate-off voltage according to a preset PWM duty ratio (%). As the light-emitting element EL turns on and off repetitively according to a preset duty ratio during the first emission time Tem1, flicker and ghost images may be reduced. The current of the light-emitting element EL in a saturated region of the first driving element DT1 is represented by Equation 1:

$$I_{OLED} = \frac{W}{L} C_{OX} \mu (Vgs - Vth)^2 \quad \text{[Equation 1]}$$

where W is the channel width of the transistor, and L is the channel length of the transistor. Cox is the parasitic capacitance of the transistor. Vgs is the gate-source voltage of the transistors, and Vth is the threshold voltage of the transistor.

As shown in FIGS. 3A to 3D, the first driver 101A drives the light-emitting element EL after compensating for the threshold voltage Vth of the first driving element DT1 in real time. In this case, no current flows in the second driver 101B, which prevents cumulative stress on the second driving element DT2 and achieves degradation recovery. The first driver 101A does not operate during operation of the second driver 101B shown in FIGS. 4A to 4D.

Figure 4A:
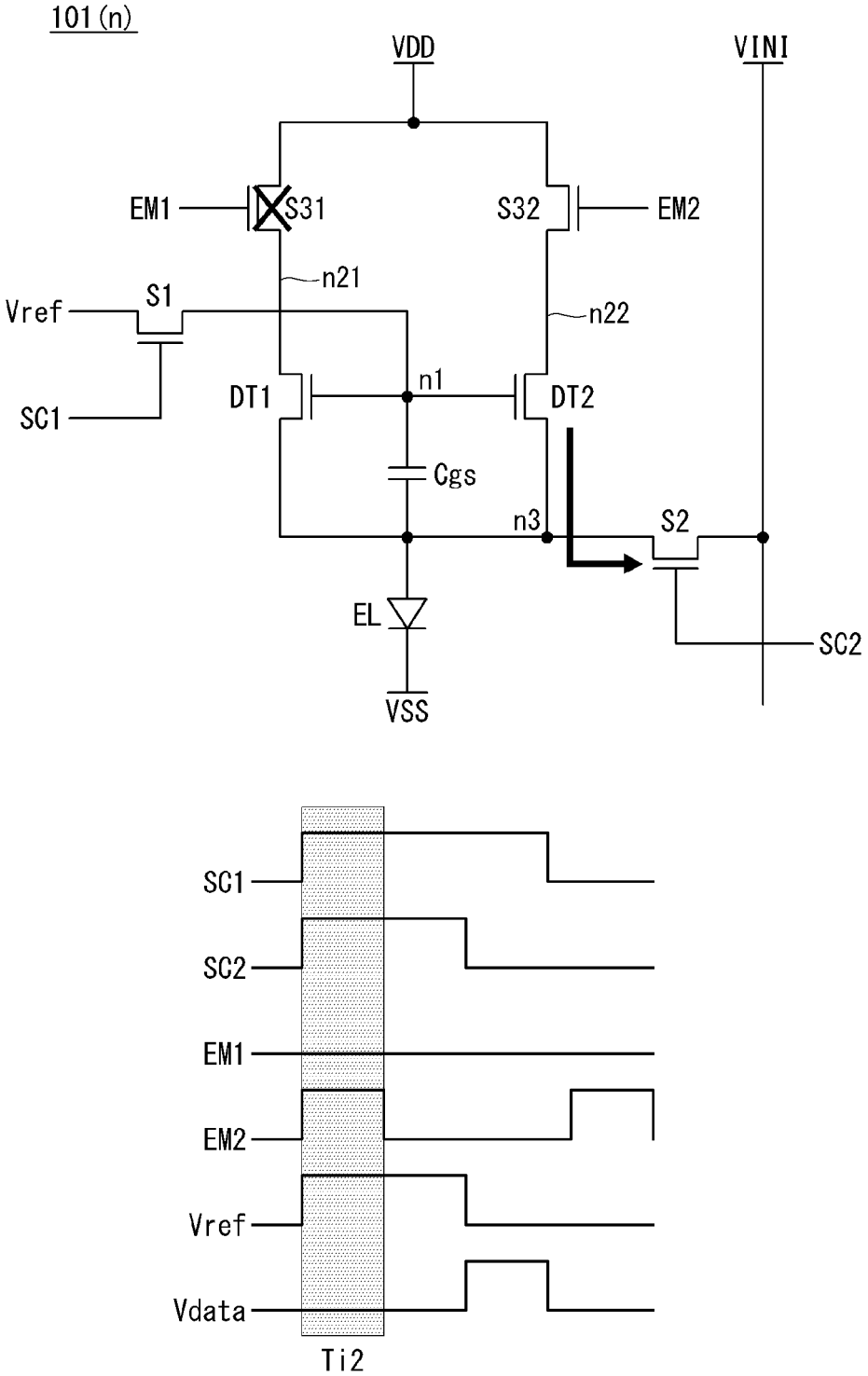

Referring to FIG. 4A, the scan signals SC1 and SC2 and the second EM signal EM2 change into the gate-on voltage when the second reset time Ti2 starts. The first EM signal EM1 is held at the gate-off voltage during operation of the second driver 101B. Thus, the switching elements S1, S2, and S32, other than the (3-1)th switching element S31, are turned on during the second reset time Ti2.

During the second reset time Ti2, the reference voltage Vref is supplied to the data lines 102. During the second reset time Ti2, the first switching element S1 turns on in response to the gate-on voltage of the first scan signal SC1, and the second switching element S2 turns on in response to the gate-on voltage of the second scan signal SC2. The (3-2)th switching element S32 turns on in response to the gate-on voltage of the second EM signal EM2.

The voltage of each node in the pixel circuit is reset during the second reset time Ti2. During the second reset time Ti2, the first node n1 is reset to Vref, the (2-2)th node n22 is reset to VDD, and the third node n3 is reset to VINI.

Figure 4B:
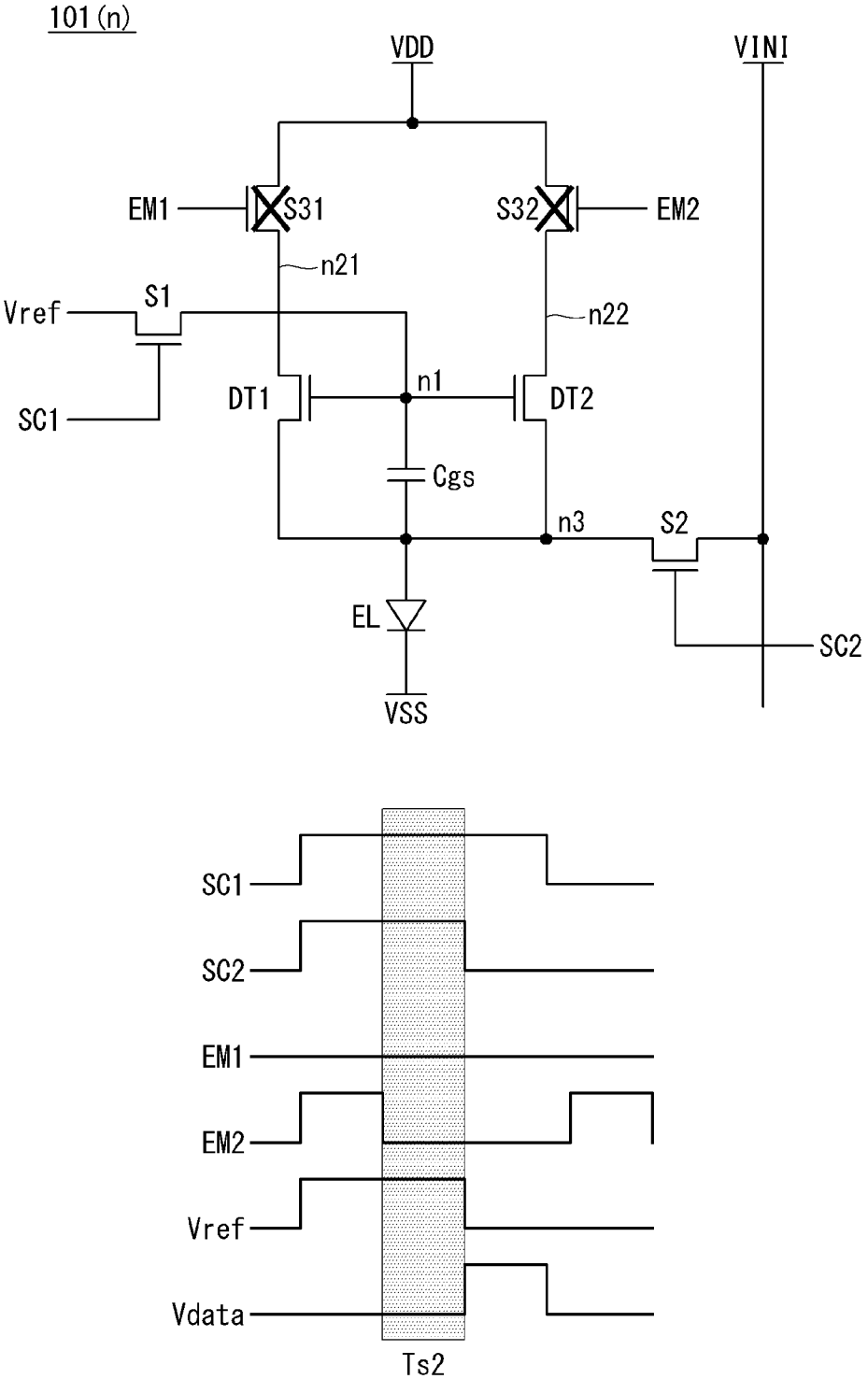

Referring to FIG. 4B, when a second sampling time Ts2 starts, the second EM signal EM2 is inverted to the gate-off voltage to turn off the (3-2)th switching element S32. During the second sampling time Ts2, the first and second scan signals SC1 and SC2 are held at the gate-on voltage, and the first EM signal EM1 is held at the gate-off voltage. Thus, during the second sampling time Ts2, the (3-1)th and (3-2)th switching elements S31 and S32 are turned off, whereas the first and second switching elements S1 and S2 are turned on.

During the second sampling time Ts2, the reference voltage Vref is supplied to the data lines 102, and the voltage of the third node n3 is held at VINI. During the second sampling time Ts2, the gate-source voltage Vgs of the second driving element DT2 becomes higher by the threshold voltage Vth, and this threshold voltage Vth is stored in the storage capacitor Cgs.

Figure 4C:
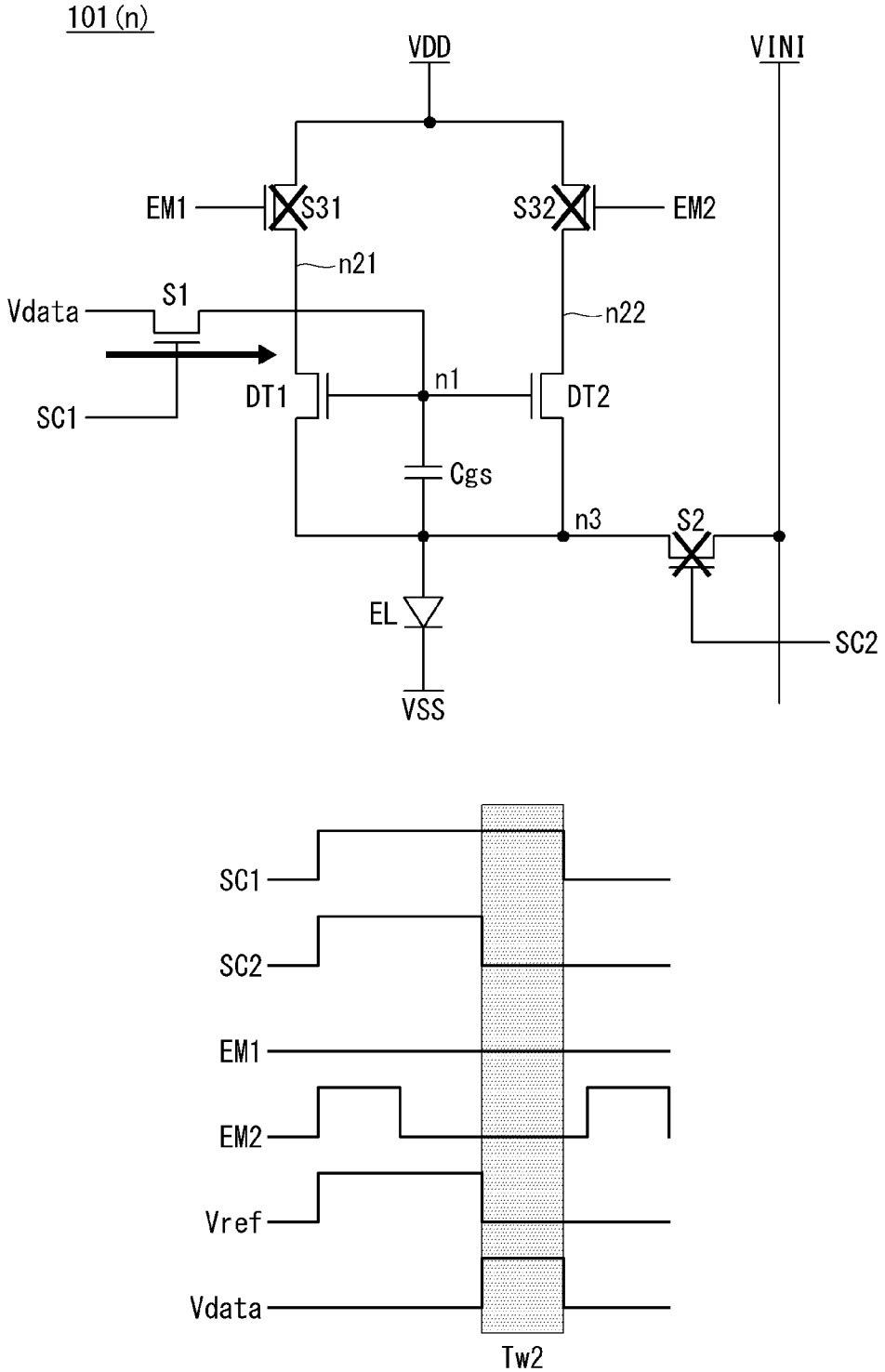

Referring to FIG. 4C, when a second data writing time Tw2 starts, the second scan signal SC2 is inverted to the gate-off voltage. During the second data writing time Tw2, the first scan signal SC1 is held at the gate-on voltage, and the first and second EM signals EM1 and EM2 are held at the gate-off voltage. Thus, during the second data writing time Tw2, the first switching element S1 remains in the on state and supplies a data voltage Vdata to the first node n1, whereas the other switching elements S2, S31, and S32 are turned off.

In the second data writing time Tw2, the gate-source voltage Vgs of the second driving element DT2 changes into a data voltage offset by the threshold voltage Vth of the second driving element DT2.

Figure 4D:
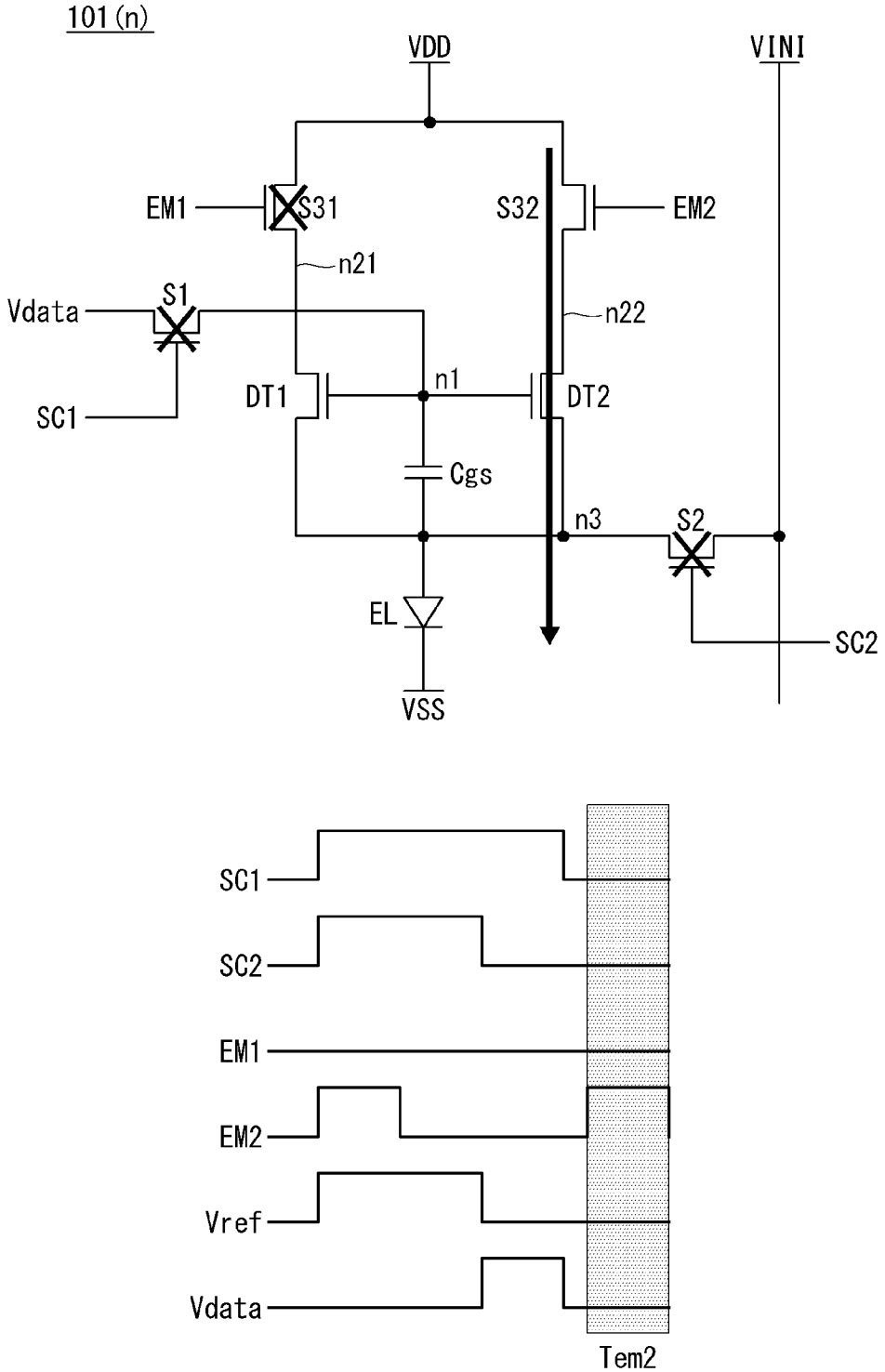

Referring to FIG. 4D, when a second emission time Tem2 starts, the first scan signal SC1 is inverted to the gate-off voltage, and the second EM signal EM2 is inverted to the gate-on voltage. During the second emission time Tem2, the second scan signal SC2 is held at the gate-off voltage, and the first EM signal EM1 is held at the gate-off voltage. Thus, during the second emission time Tem2, the (3-2)th switching element S32 is turned on, whereas the other switching elements S1, S2, and S31 are turned off.

During the second emission time Tem2, current flows in the light-emitting element EL in response to the gate-source voltage Vgs of the second driving element DT2, thereby causing the light-emitting element EL to emit light. During the second emission time Tem2, the second EM signal EM2 may be generated as an alternating current signal according to a preset PWM duty ratio (%). As the light-emitting element EL turns on and off repetitively according to a preset duty ratio during the second emission time Tem2, flicker and ghost images may be reduced.

As shown in FIGS. 4A to 4D, the second driver 101B drives the light-emitting element EL after compensating for the threshold voltage Vth of the second driving element DT2 in real time. In this case, no current flows in the first driver 101A, which prevents cumulative stress on the first driving element DT1 and achieves degradation recovery.

Figure 5:
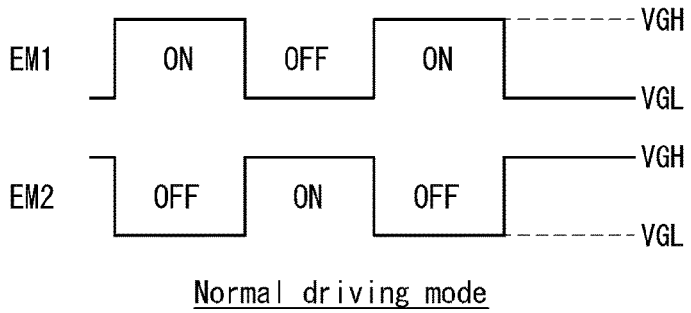
FIG. 5 is a waveform diagram showing an example of light-emission control signals in normal driving mode.

In normal driving mode, in which data of an input image is written to the pixels in every frame to reproduce the input image on the screen, the first and second drivers 101A and 101B of the pixel circuit may are operated alternately at predetermined time intervals by the EM signals EM1 and EM2 which are alternately turned on/off as shown in FIG. 5.

In low power consumption driving mode, power consumption is lowered since the operating frequency of the display panel drive circuit 110, 112, and 120 and the pixels is decreased. For example, the frame rate may be set to 60 Hz in normal driving mode. The display panel drive circuit 110, 112, and 120 write data at 60 frames per second in normal driving mode.

Figure 6:
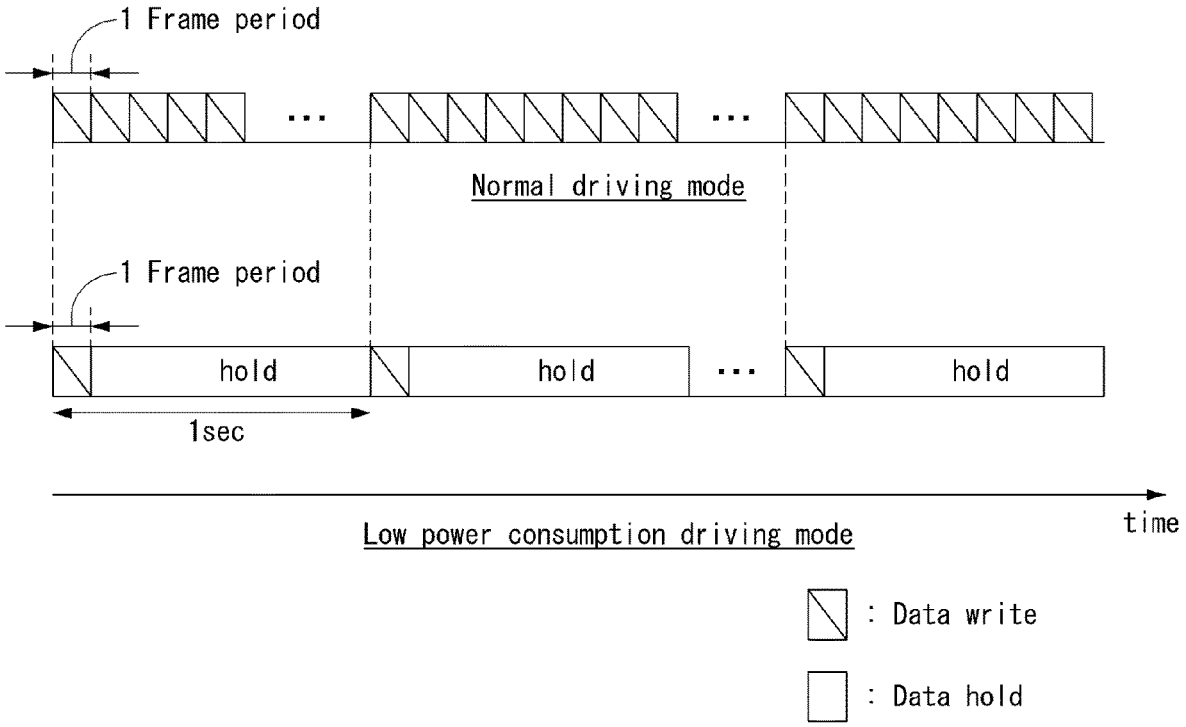
FIG. 6 is a view showing normal driving mode and low power consumption driving mode.

In low power consumption driving mode, the operating frequency of the display panel drive circuit 110, 112, and 120 and the pixels may be decreased, compared to normal driving mode in which images are reproduced on the screen. The frame rate in low power consumption driving mode may be reduced to 1 Hz, for example. The image data written to the pixels in low power consumption driving mode is updated at a lower frequency than in normal driving mode. In this case, as exemplified in FIG. 6, in low power consumption driving mode, the display panel drive circuit 110, 112, and 120 writes data of an input image to the pixels during the first frame (16.67 ms) out of 60 frames and outputs no data during the remaining 59 frames. In low power consumption driving mode, data is written to the pixels once during the first frame FR in every second, and the displayed image is maintained at the data voltages stored in the storage capacitors Cgs during the remaining time.

If the switching elements and driving elements of the pixel circuit are implemented as oxide TFTs with low leakage current, the pixels have low leakage current during a plurality of skipped frames during which data voltages of an input image are not inputted in low power consumption driving mode, thereby reproducing images with no visible flicker and reducing power consumption.

One of the first and second drivers 101A and 101B may operate in normal driving mode, and the other may operate in low power consumption driving mode. In an example, the first driver 101A may operate in normal driving mode and the second driver 101B may operate in low power consumption driving mode, but the present disclosure is not limited to this. In another example, the first and second drivers 101A and 101B may operate alternately in normal driving mode, and the second driver 101B may operate in low power consumption driving mode.

Figure 7:
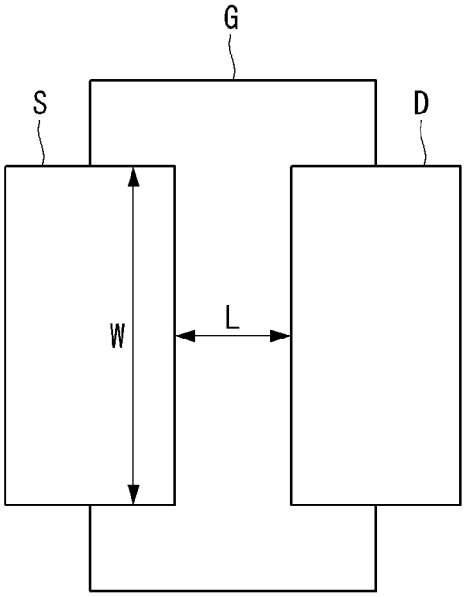
FIG. 7 is a view showing the width and length of a semiconductor channel layer in a transistor.

By reducing the channel width-to-length ratio (W/L) of a driving element that operates in low power consumption driving mode, the current of the light-emitting element may be decreased, and power consumption may be further reduced. This exemplary aspect will be described in detail in conjunction with FIGS. 8 and 9. W is the width of a semiconductor channel layer of the transistor, and L is the length of the semiconductor channel layer of the transistor. In FIG. 7, "G" denotes the gate of the transistor, "D" denotes the drain of the transistor, and "S" denotes the source of the transistor.

In the present disclosure, a transistor for normal driving and a transistor for low power consumption driving may have different channel width-to-length ratios by taking power consumption and operating characteristics into account. For example, the channel width-to-length ratio (W/L) of the transistor for normal driving may be lower than the channel width-to-length ratio (W/L) of the transistor for low power consumption driving.

In the present disclosure, VDD may be controlled to differ depending on whether the transistor for normal driving or the transistor for low power consumption driving is driven, in order for the pixels to have the same brightness even though the transistor for normal driving and the transistor for low power consumption driving have different channel width-to-length ratios. The timing controller or the host system may adjust the voltage level of VDD output from the power circuit by controlling the PWM duty ratio (%) of the power circuit.

Figure 8:
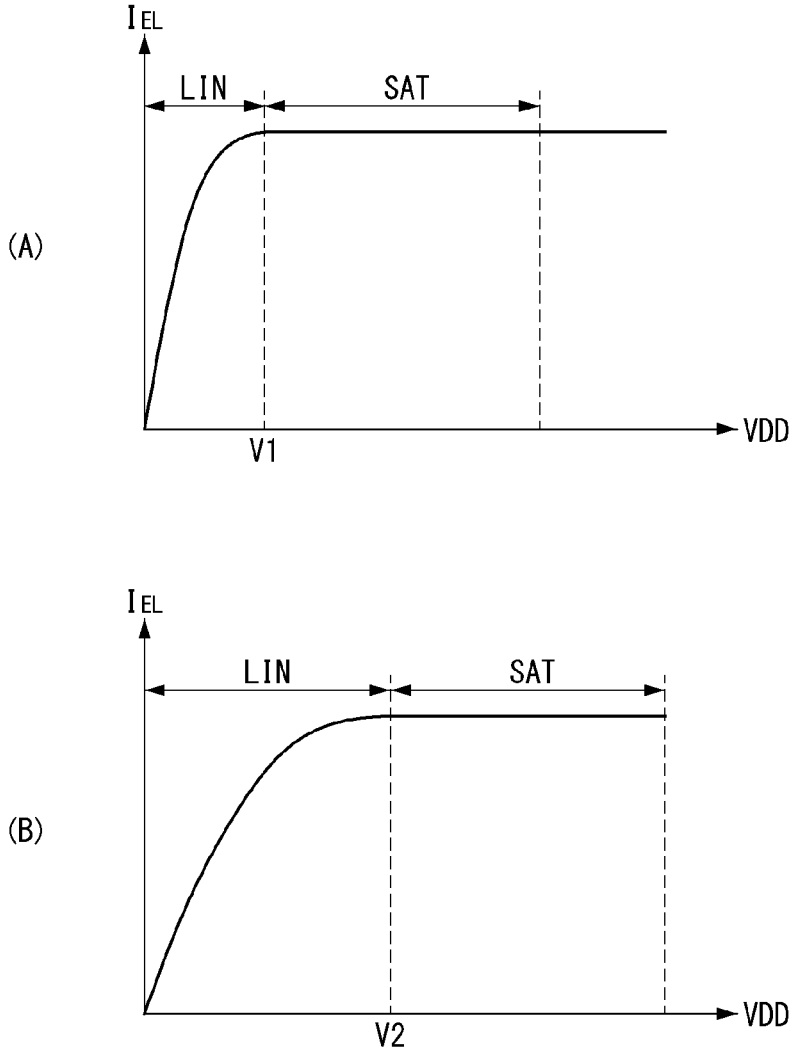
FIG. 8 is a view showing the transfer characteristics of a transistor for normal driving and a transistor for low power consumption driving.

If the channel width-to-length ratio (W/L) of the transistor for low power consumption driving is lower than that of the transistor for normal driving, the linear region LIN of the transistor for low power consumption driving is narrow, as in (A) of FIG. 8. In other words, even if VDD is set to a low voltage like V1 in low power consumption driving mode, the transistor for low power consumption driving operates in the saturated region.

When two transistors with different channel width-to-length ratios W/L are connected to a single light-emitting element, VDD may be varied so that the light-emitting element has the same brightness. To this end, in the case of a transistor for normal driving with a relatively higher channel width-to-length ratio (W/L) in normal driving mode, VDD may be set to V2 higher than V1, as shown in (B) of FIG. 8.

In the case of a transistor for low power consumption driving with a relatively higher channel width-to-length ratio (W/L), a large current flows even at a low operating voltage, as can be seen from FIG. 8, which causes more stress and more rapid degradation. In the present disclosure, the duty ratio of an EM signal EM1 for low power consumption driving may be set lower than that of an EM signal EM2 for normal driving, as shown in FIG. 9, in order to reduce cumulative stress on the transistor for low power consumption driving to a level similar to that of the transistor for normal driving and provide a relatively long recovery time.

Figure 9:
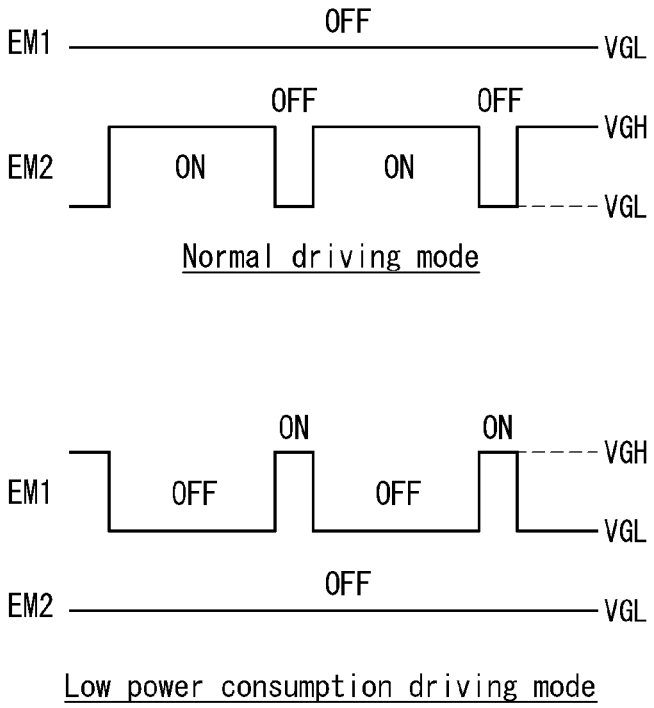
FIG. 9 is a waveform diagram showing an example of light emission control signals in normal driving mode and low power consumption mode.

FIG. 9 is a waveform diagram showing an example of EM signals EM1 and EM2 in normal driving mode and low power consumption mode, when the second driving element DT2 is a transistor for normal driving and the first driving element DT1 is a transistor for low power consumption driving. The EM signals in normal driving mode and low power consumption driving mode are not limited to those of FIG. 9.

Referring to FIG. 9, in normal driving mode, the first EM signal EM1 may be deactivated, and the second EM signal EM2 may be activated. During the emission time Tem1 and Tem2 of normal driving mode, the second EM signal EM has a predetermined duty ratio. The second EM signal EM2 is generated as an alternating current signal that swings between the gate-on voltage and the gate-off voltage according to a preset PWM duty ratio to control the on/off of the current path of the second driver 101B. The first EM signal EM1 is deactivated in normal driving mode to hold the gate-off voltage VGL. Thus, in normal driving mode, the light-emitting element EL is driven by the current from the second driver 101B. In normal driving mode, no current is generated from the first driver 101A.

In low power consumption driving mode, the second EM signal EM2 may be deactivated, and the first EM signal EM1 may be activated. During the emission time Tem1 and Tem2 of low power consumption driving mode, the first EM signal EM has a relatively lower duty ratio. In low power consumption driving mode, the duty ratio of the first EM signal EM1 is set lower than the duty ratio of the second EM signal EM2 set for normal driving mode, in order to reduce the stress on the first driving element EM1 and provide a relatively long recovery time. As a result, the on time ON of one cycle of the first EM signal EM1 may be set longer than the off time OFF. Also, the on time ON of one cycle of the first EM signal EM1 may be shorter than the on time ON of one cycle of the second EM signal EM2.

In low power consumption driving mode, the first EM signal EM1 is generated as an alternating current signal that swings between the gate-on voltage and the gate-off voltage to control the on/off of the current path of the first driver 101A. The second EM signal EM2 is deactivated in low power consumption driving mode to hold the gate-off voltage VGL. Thus, in low power consumption driving mode, the light-emitting element EL is driven by the current from the first driver 101A. In normal driving mode, no current is generated from the second driver 101B.

Figure 10:
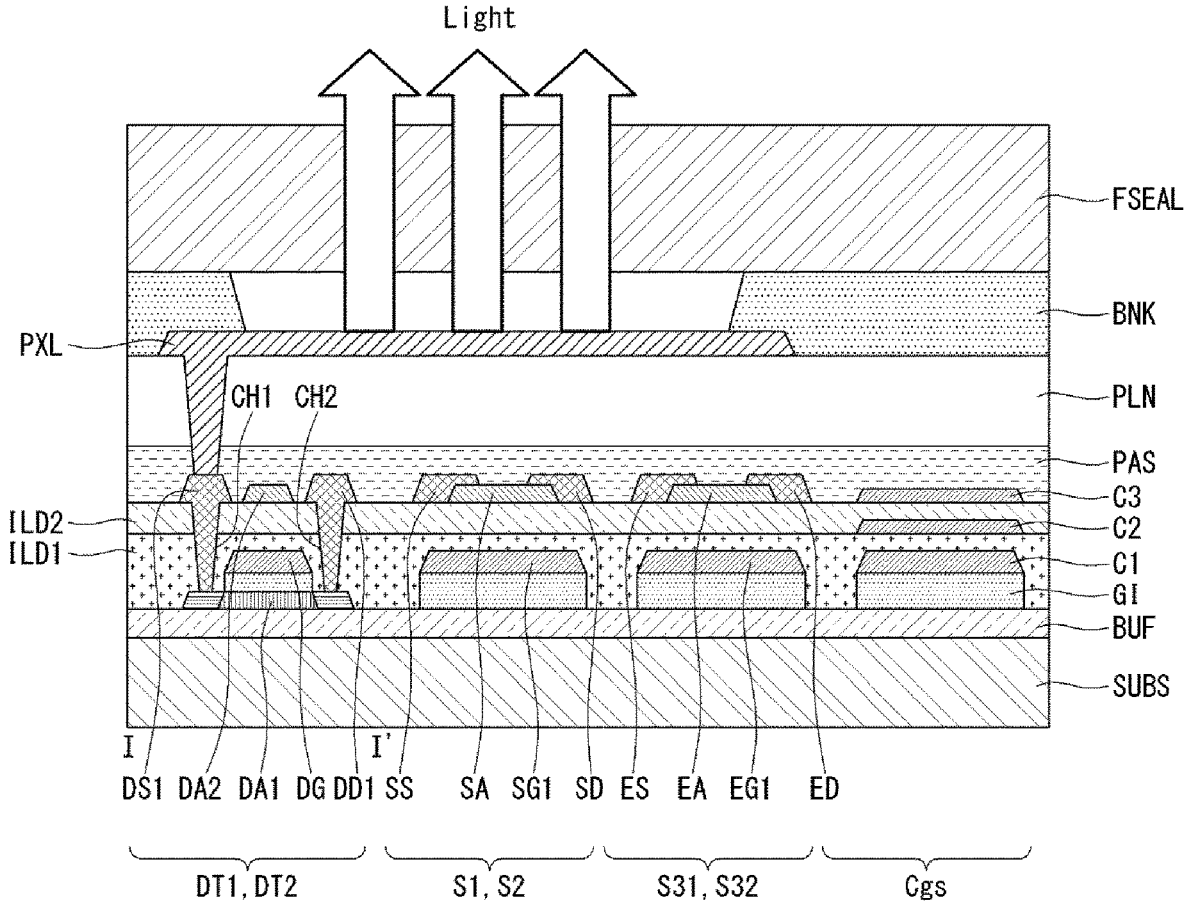
FIGS. 10 and 11 are cross-sectional views of a display panel, which show a cross-sectional structure of a pixel circuit according to an exemplary aspect of the present disclosure.
Figure 11:
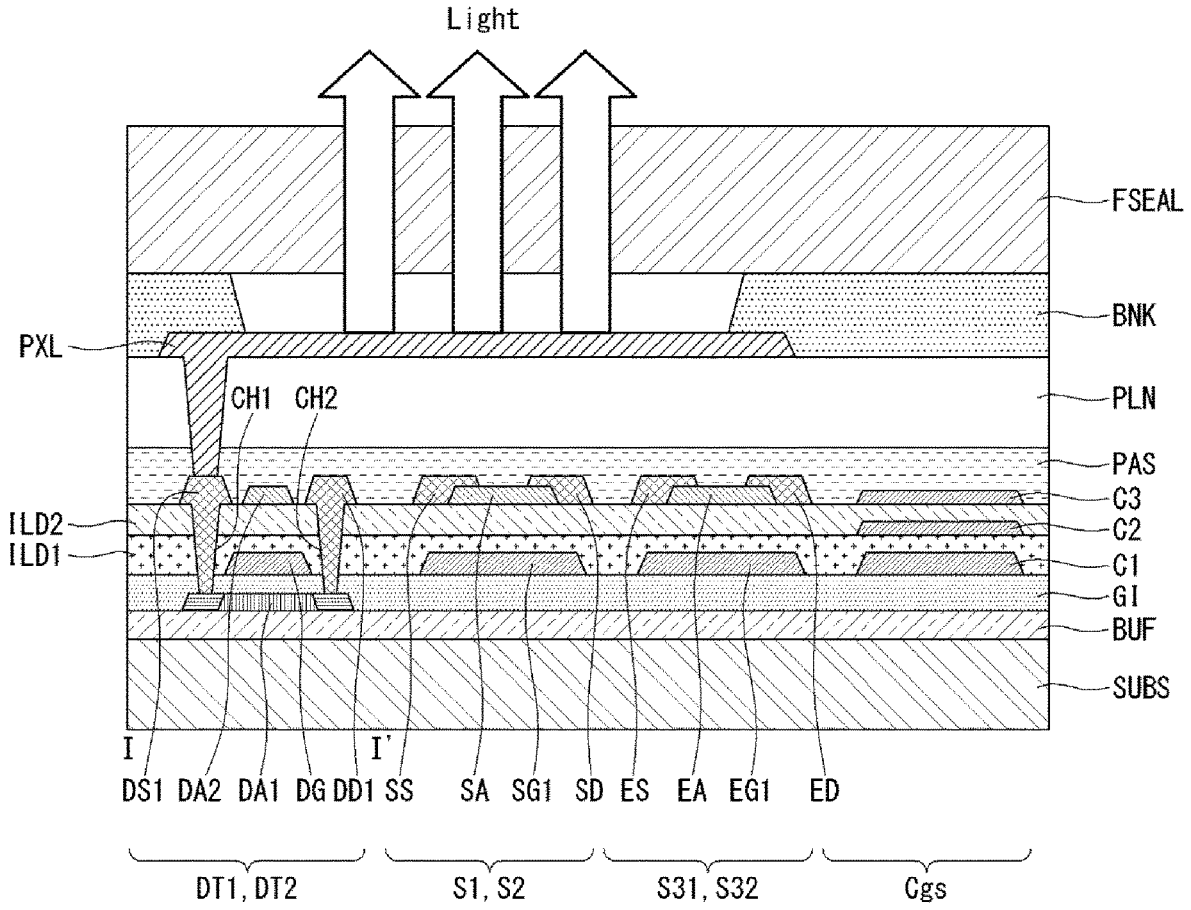

FIGS. 10 and 11 are cross-sectional views of a display panel, which show a cross-sectional structure of a pixel circuit according to an exemplary aspect of the present disclosure. FIG. 10 shows a cross-sectional structure on which a dry etching process is performed to reduce resistance in semiconductor patterns of transistors. FIG. 11 is a cross-sectional structure in which semiconductor patterns of transistors are doped with ions to increase the conductivity of the semiconductor pattern.

Referring to FIGS. 10 and 11, the display panel of the disclosure comprises a plurality of transistors arranged in a pixel array area. These transistors comprise the driving elements DT1 and DT2 and switching elements S1 to S32 in the pixel circuit of FIG. 2. Along with the transistors DT1, DT2, and S1 to S32, a storage capacitor Cgs, a light-emitting element EM, etc., are provided on a substrate of the display panel. "PXL" denotes the pixel electrode (or anode) of the light-emitting element. The transistors DT1, DT2, and S1 to S32 may be implemented as NMOS oxide TFTs. By implementing all the transistors in the pixel circuit as NMOS oxide TFTs, the number of fabrication processes and the display panel structure can be simplified, compared to a pixel circuit with both NMOS transistor sand PMOS transistors.

The first and second driving elements DT1 and DT2 are stacked vertically on the substrate and share a single gate DG. To share a gate, one of the first and second driving elements DT1 and DT2 may be implemented as a top-gate transistor in which the gate DT is placed over a semiconductor pattern DA1, and the other may be implemented as a bottom-gate transistor in which the gate DG is placed under a semiconductor pattern DA2. The switching elements S1 to s32 may be implemented as bottom-gate transistors. By fabricating a display panel with two driving elements DT1 and DT2 sharing one gate DG, the number of fabrication processes of the display panel and the structure thereof can be simplified.

Figure 12:
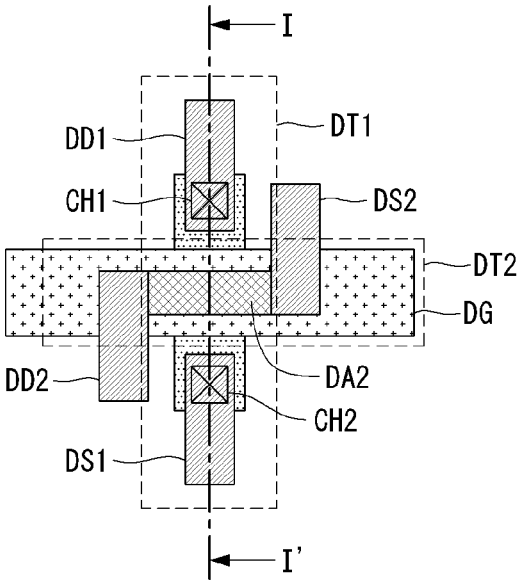
FIG. 12 is a plane view showing a planar structure of the driving elements of FIGS. 10 and 11.

A description will be given with an example in which the first driving element DT1 has a top-gate structure and the second driving element DT2 has a bottom-gate structure, but the present disclosure is not limited to this example. In this case, the first driving element DT1 comprises a first semiconductor pattern DA1, a common gate DG placed over the first semiconductor pattern DA1, a first electrode DD1 contacting the drain region of the first semiconductor pattern DA1, and a second electrode DS1 contacting the source region of the first semiconductor pattern DA1. The second driving element DT2 comprises a second semiconductor pattern DA2, the common gate DG placed under the second semiconductor pattern DA2, a first electrode DD2 (as shown in FIG. 12) contacting the drain region of the second semiconductor pattern DA2, and a second electrode DS2 (as shown in FIG. 12) contacting the source region of the second semiconductor pattern DA2. The first and second electrodes DS2 and DD2 of the second driving element DT2 are omitted in FIGS. 10 and 11, but are depicted in the plane view of FIG. 12. Conversely, it should be noted that the second driving element DT2 may have a top-gate structure and the first driving element DT1 may have a bottom-gate structure.

The first and second switching elements S1 and S2 each comprises a semiconductor pattern SA, a gate SG1 placed under the semiconductor pattern SA, a first electrode SD contacting the drain region of the semiconductor pattern SA, and a second electrode SS contacting the source region of the semiconductor pattern SA. The (3-1)th and (3-2)th switching elements S31 and S32 each comprises a semiconductor pattern EA, a gate EG1 placed under the semiconductor pattern EA, a first electrode ED contacting the drain region of the semiconductor pattern EA, and a second electrode ES contacting the source region of the semiconductor pattern EA.

The storage capacitor Cgs has a large capacity, with two capacitors stacked vertically on the substrate SUBS. The capacitor Cgs comprises a first capacitor comprising a first electrode C1 and a common electrode C2 and a second capacitor comprising the common electrode C2 and a second electrode C3. To simplify the photomasking process, the storage capacitor Cgs may be formed without the common electrode C2.

The semiconductor patterns DA1, DA2, SA, and EA of the driving elements DT1 and DT2 and switching elements S1 to S32 comprise at least one semiconductor material among indium gallium zinc oxide (IGZO), indium gallium oxide (IGO), and indium zinc oxide (IZO).

A buffer layer BUF is deposited over the entire surface of the substrate SUBS. The buffer layer BUF may be omitted. A first oxide semiconductor layer is deposited on the buffer layer BUF. In a first photomasking process, the first oxide semiconductor layer is patterned to form the first semiconductor pattern DA1 of the first driving element DT1 on the buffer layer BUF. The first semiconductor pattern DA1 comprises a channel region overlapping the common gate DG, and source and drain regions located on either side of the channel region and doped with n+ ions. A thermal treatment process may be performed to inject oxygen into the first semiconductor pattern DA1 and eliminate defects on the first semiconductor pattern DA1. The thermal treatment process may be omitted.

A gate insulator film GI is formed on the buffer layer BUF to cover the first semiconductor pattern DA1, and a first metal layer is deposited on the gate insulator film GI. A second photomasking process is performed to pattern the first metal layer. As exemplified in FIG. 10, the first metal layer and the gate insulator film GI are patterned all at once. As exemplified in FIG. 11, only the first metal layer is patterned in the second photomasking process. By the second photomasking process, the common gate DG of the driving elements DT1 and DT2, the gates SG1 and EG1 of the switching transistors S1 to S32, and the first electrode C1 of the storage capacitor Cgs are formed from the first metal layer.

As exemplified in FIG. 10, silicon oxide ($SiO_2$), which can be used as a gate insulator film material is dry-etched. The particles of reactive gases ionized through dry etching of oxide silicon ($SiO_2$) are supplied to the first semiconductor pattern DA1 and become conductive due to a reduction in the resistance between the source and drain regions of the semiconductor pattern DA1. Oxide semiconductor becomes conductive as the resistance decreases when ionized impurities produced by the dry etching process are injected. As shown in FIG. 11, to reduce the resistance between the source and drain regions of the first semiconductor pattern DA1, the first semiconductor pattern DA1, covered by the gate insulator film GI, may be doped with ions by using a pattern of the common gate DG as a mask.

A first interlayer insulator film ILD1 covers the first metal layer patterns DG, SG1, and EG1. The common electrode C2 of the storage capacitor Cgs is formed on the first interlayer insulator film ILD1. A second interlayer insulator film ILD2 is formed on the first interlayer insulator film ILD1 to cover the common electrode C2. To reduce the number of photomasking processes, the common electrode C2 may be omitted, and an interlayer insulator film consisting of a single layer may be formed.

A second oxide semiconductor layer is deposited on the second interlayer insulator film ILD2. In a third photomasking process, the second oxide semiconductor layer is patterned to form the second semiconductor pattern DA2 of the second driving element DT2 and the semiconductor patterns SA and EA of the switching elements S1 to S32 on the second interlayer insulator film ILD2. The second semiconductor pattern DA2 comprises a channel region overlapping the common gate DG, and source and drain regions located on either side of the channel region and doped with n+ ions. A thermal treatment process may be performed to inject oxygen into the second semiconductor pattern DA2 and eliminate defects on the second semiconductor pattern DA2. The thermal treatment process may be omitted.

In a fourth photomasking process, contact holes CH1 and CH2 are formed through the insulator films to expose the source and drain regions of the first semiconductor pattern DA1. After that, a second metal layer is deposited on the second interlayer insulator film ILD2. A fifth photomasking process is performed to pattern the second metal layer. By the fifth photomasking process, the first and second electrodes DD1, DS1, DD2, DS2, ES, and ED of the driving elements DT1 and DT2 and the second electrode of the storage capacitor Cgs are formed from the first metal layer.

A first passivation film PAS covers the transistors DT1, DT2, and S1 to S32. A thermal treatment process may be performed to stabilize the first passivation film PAS and supply oxygen to the semiconductor patterns DA2, SA, and EA. A second passivation film PLN is stacked on the first passivation film PAS. A sixth photomasking process may be performed to expose the source region of the second semiconductor pattern DA2. After that, a pixel electrode PXL is formed on the second passivation film PLN in a seventh photomasking process. The pixel electrode PXL makes contact with the second electrodes DS1 and DS2 of the driving elements DT1 and DT2 via contact holes formed through the passivation films PAS and PLN. A thermal treatment process may be performed to improve the reliability of the transistors DT1, DT2, and S1 to S32.

A bank pattern BNK is formed on the second passivation film PLN to define a light-emitting region of the light-emitting element EL. In the light-emitting region, an organic compound layer comprising an emission layer is stacked, and a cathode omitted in the drawings is formed on top of it. A face seal FSEAL covers the light-emitting element EL to protect the light-emitting element EL from exposure to moisture.

As described above, the first and second driving elements DT1 and DT2 are stacked vertically on the substrate of the display panel 100 and have the common gate DG. FIG. 12 is a plane view showing two driving elements DT1 and DT2 stacked on one another. A cross-sectional structure of the driving elements DT1 and DT2, taken along the line I-I' in FIG. 12, is shown in FIGS. 10 and 11.

Figure 13:
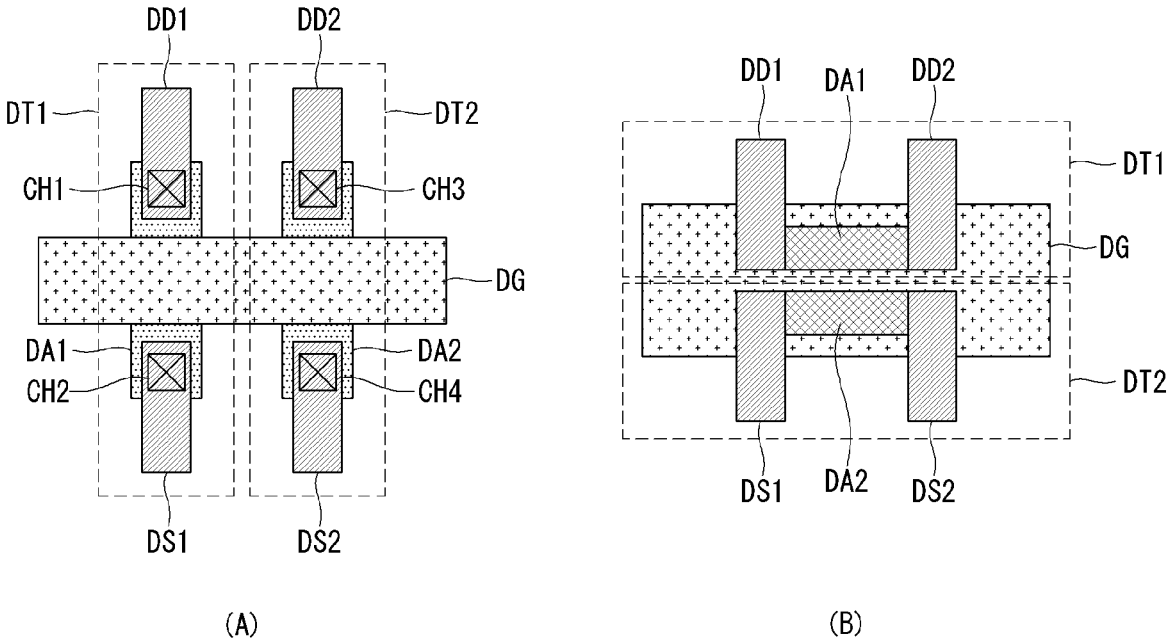
FIG. 13 is a plane view showing another planar structure of driving elements sharing a common gate.

The driving elements DT1 and DT2 may share the common gate in the way shown in FIG. 13. (A) of FIG. 13 shows an example in which both of the first and second driving elements DT1 and DT2 have a top-gate structure and the common gate DG has a second metal layer pattern. The first driving element DT1 comprises the common gate DG located over the semiconductor patterns DA1 and DA2, and the first and second electrodes DD1 and DS1 connected to the first semiconductor pattern DA1 via contact holes CH1 and CH2. The second driving element DT2 comprises the common gate DG located over the semiconductor patterns DA1 and DA2, and the first and second electrodes DD2 and DS2 connected to the second semiconductor pattern DA2 via contact holes CH3 and CH4.

(B) of FIG. 13 shows an example in which both of the first and second driving elements DT1 and DT2 have a bottom-gate structure and the common gate DG has a first metal layer pattern. The first driving element DT1 comprises the common gate DG located under the semiconductor patterns DA1 and DA2, and the first and second electrodes DD1 and DS1 connected directly to the first semiconductor pattern DA1 without via contact holes. The second driving element DT2 comprises the common gate DG located under the semiconductor patterns DA1 and DA2, and the first and second electrodes DD2 and DS2 connected directly to the second semiconductor pattern DA2 without via contact holes.

Figure 15:
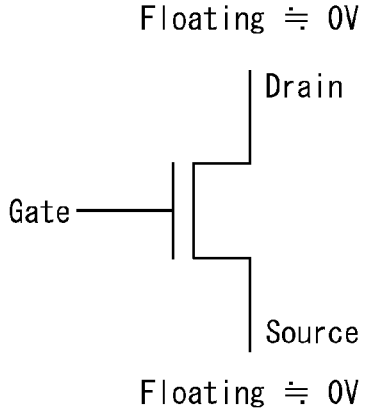
FIG. 15 is a view showing an example in which first and second electrodes of the driving elements of FIG. 14 float simultaneously.

FIG. 14 is a circuit diagram showing a pixel circuit according to a second exemplary aspect of the present disclosure. FIG. 15 is a view showing an example in which first and second electrodes of the driving elements of FIG. 14 float simultaneously. FIGS. 16A to 16D and FIGS. 17A to 17D are schematic views showing how the pixel circuit of FIG. 14 works. A method for driving the pixel circuit of FIG. 14 in normal driving mode and low power consumption driving mode may be applied in the same way as the foregoing first exemplary aspect. The channel width-to-length ratio and VDD of the driving elements of FIG. 14 may be applied in the same way as the first exemplary aspect. Also, the driving elements of FIG. 14 may have substantially the same planar and cross-sectional structures as the foregoing first exemplary aspect.

Referring to FIG. 14, the pixel circuit comprises first and second driving elements DT1 and DT2 connected to a single light-emitting element EL, first to (3-4)th switching elements S1 to S34, and a storage capacitor Cgs. VDD is supplied to the subpixels 101(*n*) via the first power supply line 21.

This pixel circuit comprises first and second drivers 101A and 101B that are operated alternately. The first driver 101A comprises the first driving element DT1 and (3-1)th and (3-3)th switching elements S31 and S33 located with the first driving element DT1 in between. The first driver 101A supplies an electrical current to the light-emitting element EL in response to first and third EM signals EM1 and EM3. The second driver 101B comprises the second driving element DT2 and (3-2)th and (3-4)th switching elements S32 and S34 located with the second driving element DT2 in between. The second driver 101B supplies an electrical current to the light-emitting element EL in response to second and fourth EM signals EM2 and EM4.

The (3-1)th and (3-3)th switching elements S31 and S33 are turned off during operation of the second driver 101B and shut off the current path connected to the first and second electrodes of the first driving element DT1. While the (3-1)th and (3-3)th switching elements S31 and S33 are turned off, the first and second electrodes of the first driving element DT1 float and no current flows between the drain and source of the first driving element DT1. The (3-2)th and (3-4)th switching elements S32 and S34 are turned off during operation of the first driver 101A and shut off the current path connected to the first and second electrodes of the second driving element DT2. While the (3-2)th and (3-4)th switching elements S32 and S34 are turned off, the first and second electrodes of the second driving element DT2 float and no current flows between the drain and source of the second driving element DT2.

The present disclosure can reduce cumulative stress on the driving elements DT1 and DT2 and induce the recovery of the driving elements DT1 and DT2 since the first electrodes of the driving elements DT1 and DT2 float alternately to shut off the current flowing between the drain and source of the driving elements DT1 and DT2. The present disclosure prevents variation in the brightness of the pixels and ghost images by offsetting data voltages Vdata by variation in the threshold voltage Vth of the driving elements DT1 and DT2 using the internal compensation method of FIGS. 16A to 17D and alternately operating the driving elements DT1 and DT2.

The driving elements DT1 and DT2 and the switching elements S1 to S32 may be implemented as NMOS oxide TFTs with an oxide semiconductor pattern. The oxide TFTs can reduce power consumption because of the small leakage current produced in the off state of the TFTs, and provide higher anti-flicker functionality by preventing a decrease in pixel voltage caused by leakage current. The driving elements DT1 and DT2 may have different channel width-to-length ratios W/L and share a common gate DG, as shown in FIGS. 10 to 13.

The light-emitting element EL may be implemented as an OLED. The OLED emits light by the current regulated by the driving elements DT1 and DT2, in response to a data voltage Vdata. The OLED comprises an organic compound layer situated between an anode and a cathode. The organic compound layer may consist of, but is not limited to, a hole injection layer (HIL), a hole transport layer (HTL), an emission layer (EML), an electron transport layer (ETL), and an electron injection layer (EIL). The anode of the OLED is connected to the driving elements DT1 and DT2 via a fourth node n4, and the cathode of the OLED is connected to a VSS electrode 23 to which the low-level power supply voltage VSS is applied. The storage capacitor Cgs is connected between the gate and source of the driving elements DT1 and DT2 via a first node n1 and the fourth nodes n4.

In response to a first scan signal SC1, the first switching element S1 supplies Vref to the first node n1 and then supplies a data voltage Vdata to the first node n1. Vref is set to a voltage that is lower than the pixel driving voltage VDD and resets the voltage of the first node n1. The first switching element S1 comprises a gate connected to a first gate line to which a first scan signal SC1 is applied, a first electrode connected to a data line, and a second electrode connected to the first node n1. Vref and Vdata are supplied to the data line.

In response to a second scan signal SC2, the second switching element S2 supplies a predetermined initial voltage VINI to the pixel electrode (or anode) of the light-emitting element EL via the fourth node n4. The initial voltage VINI is set to a voltage at which the light-emitting element EL emits no light. The initial voltage VINI is lower than VDD. The second switching element S2 comprises a gate connected to a second gate line to which a second scan signal SC2 is applied, a first electrode connected to the second power supply line 22 to which VINI is applied, and a second electrode connected to the fourth node n4.

In response to a first EM signal EM1, the (3-1)th switching element S31 switches the current path between VDD and the first electrode of the first driving element DT1. The (3-1)th switching element S31 comprises a gate connected to a (3-1)th gate line to which the first EM signal EM1 is applied, a first electrode connected to the first power supply line 21 via a (2-1)th node n21, and a second electrode connected to the first electrode of the first driving element DT1 via the (2-1)th node n21.

In response to a third EM signal EM3, the (3-3)th switching element S33 switches the current path between VDD and the second electrode of the first driving element DT1. The (3-3)th switching element S33 comprises a gate connected to a (3-3)th gate line to which the third EM signal EM3 is applied, a first electrode connected to the second electrode of the first driving element DT1 via a (3-1)th node n31, and a second electrode connected to the anode of the light-emitting element EL via the fourth node n4.

The first driving element DT1 regulates the current of the light-emitting element EL in response to a gate-source voltage Vgs. The first driving element DT1 and the second driving element DT2 alternately drive the light-emitting element EL. The first driving element DT1 comprises a gate connected to the first node n1, a first electrode connected to the (2-1)th node n21, and a second electrode connected to the (3-1)th node n31.

In response to a second EM signal EM2, the (3-2)th switching element S32 switches the current path between the first power supply line 21, to which VDD is applied, and the second driving element DT2. The (3-2)th and (3-4)th switching elements S32 and S34 are turned on during a light emission time, in which the (3-1)th and (3-3)th switching elements S31 and S33 are turned off, to form a current path between VDD and the light-emitting element EL. The (3-2)th switching element S32 comprises a gate connected to a (3-2)th gate line to which the second EM signal EM2 is applied, a first electrode connected to the first power supply line 21 via a (2-2)th node n22, and a second electrode connected to the first electrode of the second driving element DT2 via the (2-2)th node n22.

In response to a fourth EM signal EM4, the (3-4)th switching element S34 switches the current path between VDD and the second electrode of the second driving element DT2. The (3-4)th switching element S34 comprises a gate connected to a (3-4)th gate line to which the fourth EM signal EM4 is applied, a first electrode connected to the second electrode of the second driving element DT2 via a (3-2)th node n32, and a second electrode connected to the anode of the light-emitting element EL via the fourth node n4.

The second driving element DT2 regulates the current of the light-emitting element EL in response to a gate-source voltage Vgs. The second driving element DT2 and the first driving element DT1 alternately drive the light-emitting element EL. The second driving element DT2 comprises a gate connected to the first node n1, a first electrode connected to the (2-2)th node n22, and a second electrode connected to the (3-2)th node n32.

FIGS. 16A to 17D are views showing how the pixel circuit 101(*n*) of an nth subpixel works. Each pixel circuit is driven by the internal compensation method of FIGS. 16A to 17D to sample the threshold voltage Vth of the driving elements DT1 and DT2 and offset data voltages Vdata by threshold voltage Vth. FIGS. 16A to 16D show how the light-emitting element EL is driven by the first driver 101A in a step-by-step manner. FIGS. 17A to 17D show how the light-emitting element EL is driven by the second driver 101B in a step-by-step manner.

Figure 16A:
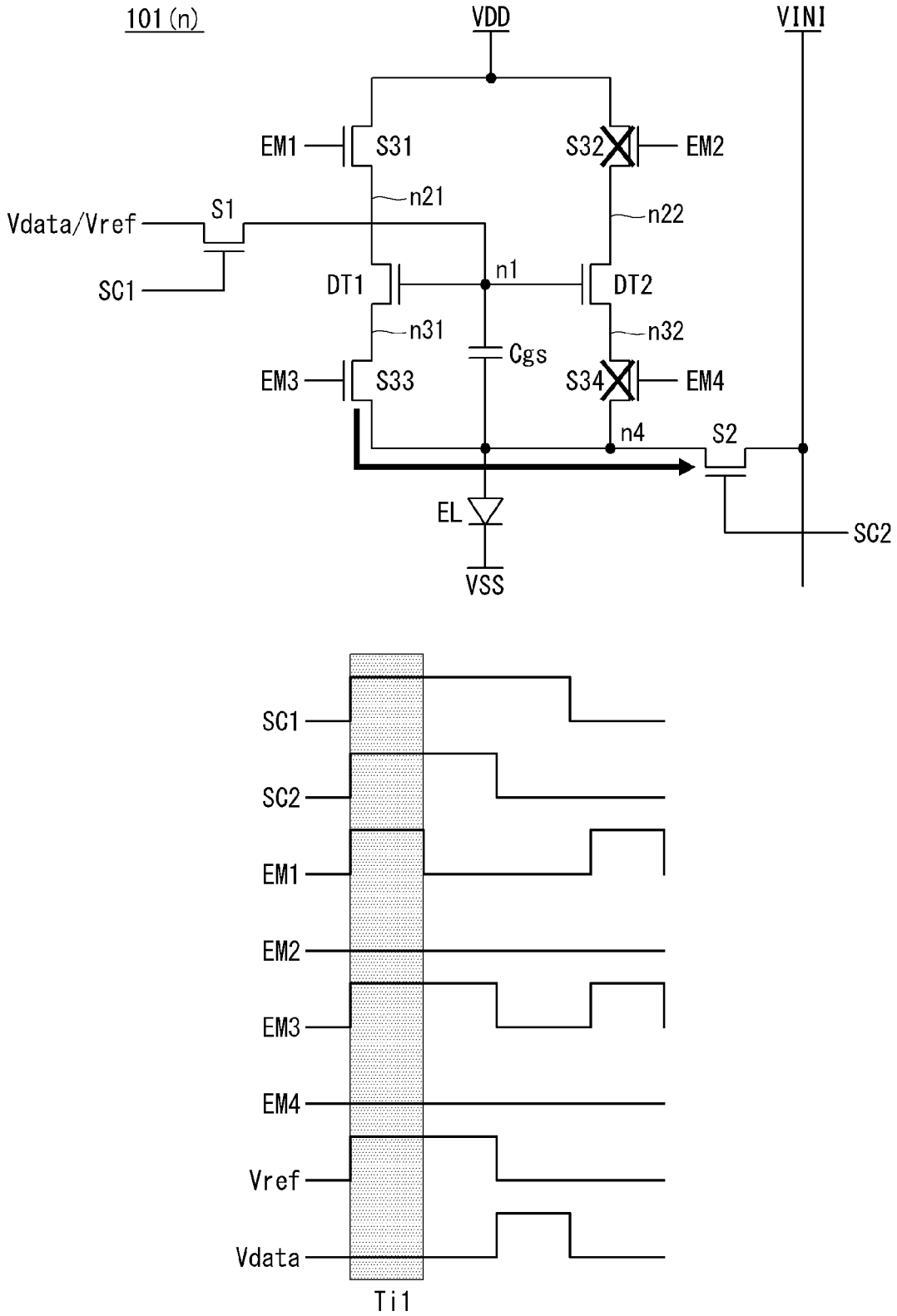
FIGS. 16A to 16D and FIGS. 17A to 17D are schematic views showing how the pixel circuit of FIG. 14 works.

Referring to FIG. 16A, the first and second scan signals SC1 and SC2 and the first and third EM signals EM1 and EM3 change into the gate-on voltage when a first reset time Ti1 starts. The second and fourth EM signals EM2 and EM4 are held at the gate-off voltage during operation of the first driver 101A. In NMOS, the gate-on voltage is set to the gate-high voltage VGH, and the gate-off voltage is set to the gate-low voltage VGL. Thus, the switching elements S1, S2, S31, and S33, other than the (3-2)th and (3-4)th switching elements S32 and S34, are turned on during the first reset time Ti1.

During the first reset time Ti1, Vref is supplied to the data lines 102. During the first reset time Ti1, the first switching element S1 turns on in response to the gate-on voltage of the first scan signal SC1, and the second switching element S2 turns on in response to the gate-on voltage of the second scan signal SC2. The (3-1)th switching element S31 turns on in response to the gate-on voltage of the first EM signal EM1. The (3-3)th switching element S31 turns on in response to the gate-on voltage of the third EM signal EM3. The voltage of each node in the pixel circuit is reset during the first reset time Ti1. During the first reset time Ti1, the first node n1 is reset to Vref, the (2-1)th node n21 is reset to VDD, and the fourth node n4 is reset to VINI.

Figure 16B:
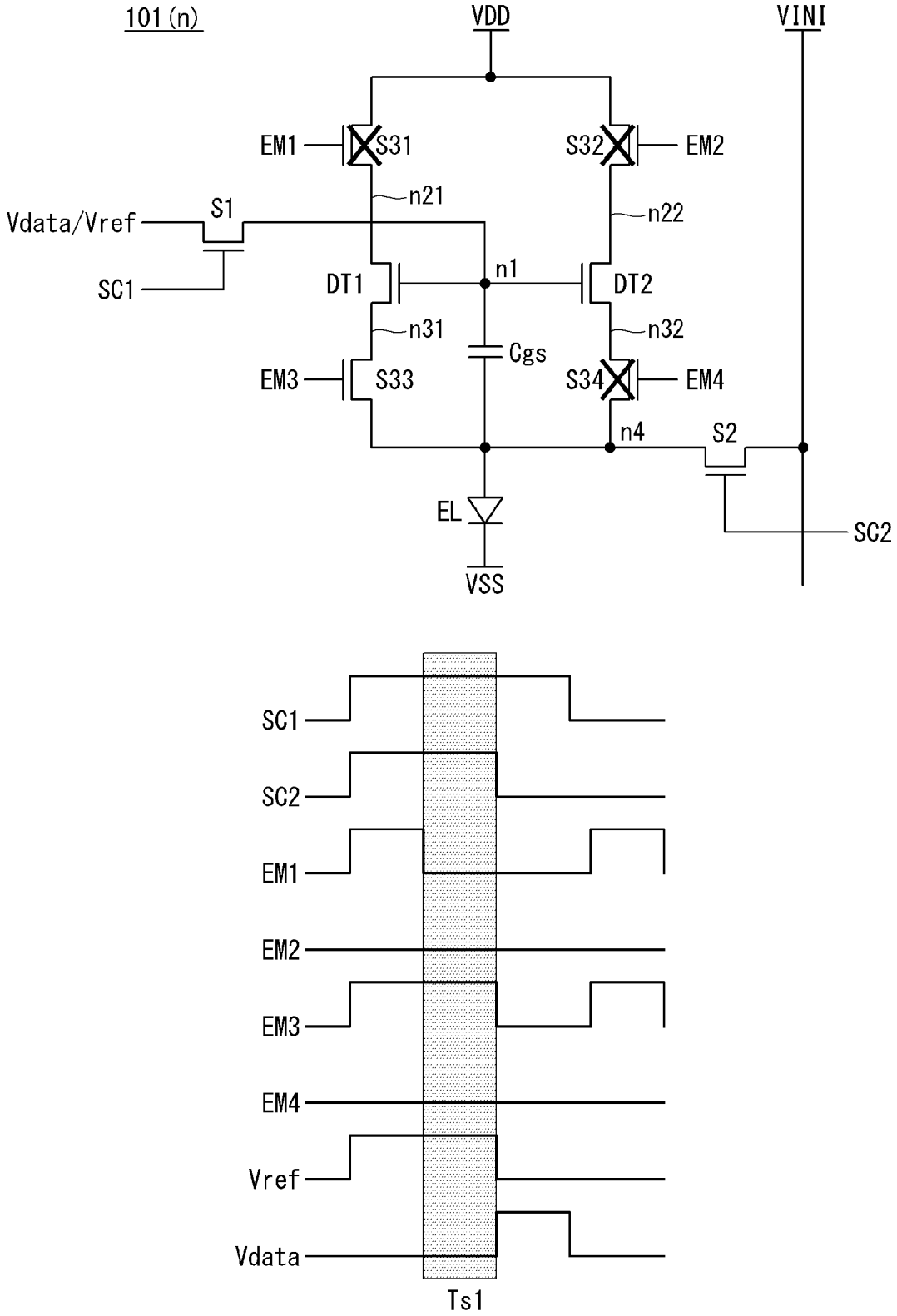

Referring to FIG. 16B, when a first sampling time Ts1 starts, the first EM signal EM1 is inverted to the gate-off voltage to turn off the (3-1)th switching element S31. During the first sampling time Ts1, the third EM signal EM3 and the first and second scan signals SC1 and SC2 are held at the gate-on voltage, and the second and fourth EM signals EM2 and EM4 are held at the gate-off voltage. Thus, during the first sampling time Ts1, the (3-1)th, (3-2)th, and (3-4)th switching elements S31, S32, and S34 are turned off, whereas the (3-3)th switching element S33 and the first and second switching elements S1 and S2 are turned on.

During the first sampling time Ts1, Vref is supplied to the data lines 102, and the voltage of the third node n3 is held at VINI. During the first sampling time Ts1, the gate-source voltage Vgs of the first driving element DT1 becomes higher by the threshold voltage Vth of the first driving element DT1, and this threshold voltage Vth is stored in the storage capacitor Cgs.

Figure 16C:
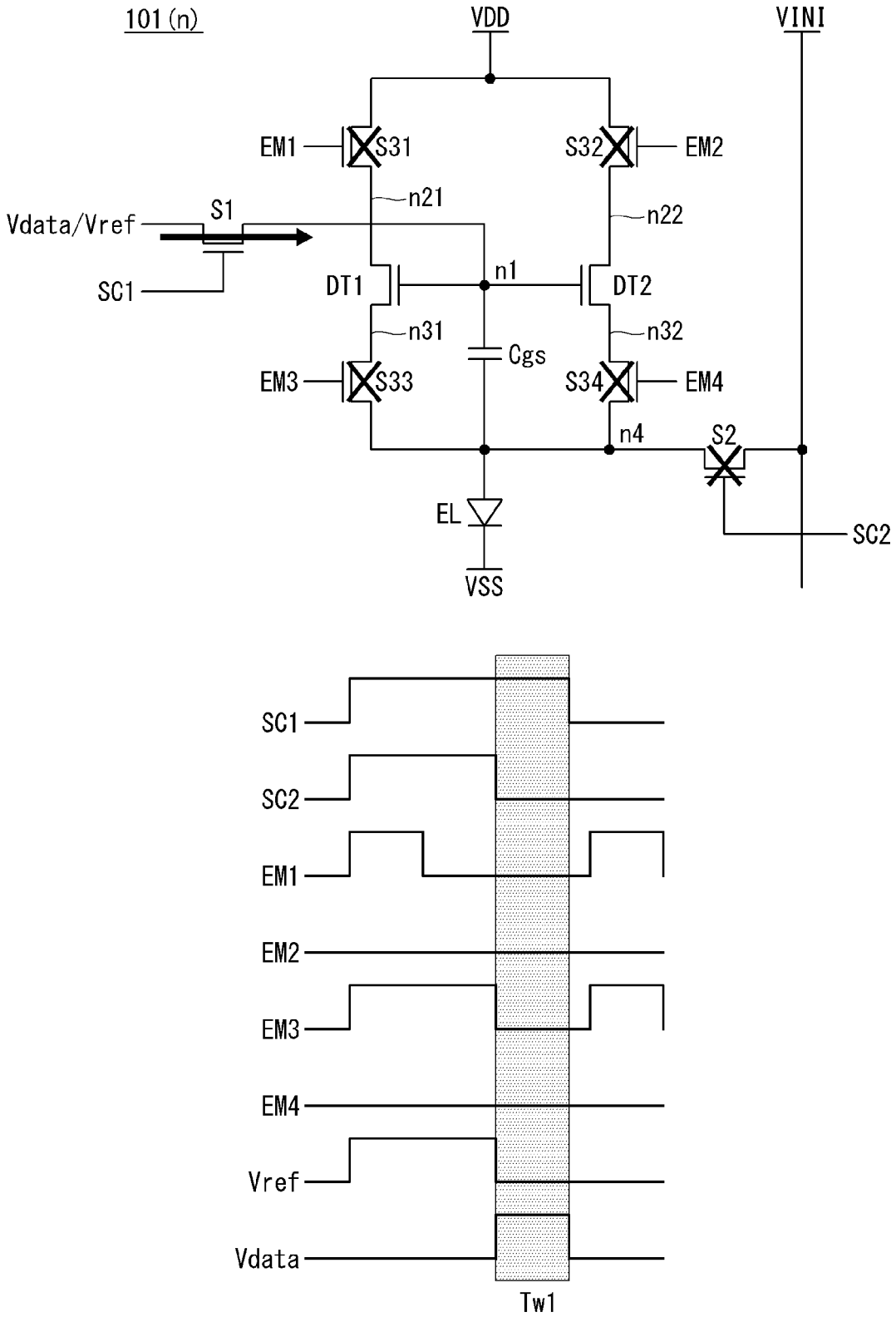

Referring to FIG. 16C, when a first data writing time Tw1 starts, the second scan signal SC2 and the third EM signal EM3 are inverted to the gate-off voltage. During the first data writing time Tw1, the first scan signals SC1 is held at the gate-on voltage, and the first, second, and fourth EM signals EM1, EM2, and EM4 are held at the gate-off voltage. Thus, during the first data writing time Tw1, the first switching element S1 remains in the on state and supplies a data voltage Vdata to the first node n1, whereas the other switching elements S2 and S31 to S34 are turned off.

In the first data writing time Tw1, the gate-source voltage Vgs of the first driving element DT1 changes into a data voltage offset by the threshold voltage Vth of the first driving element DT1.

Figure 16D:
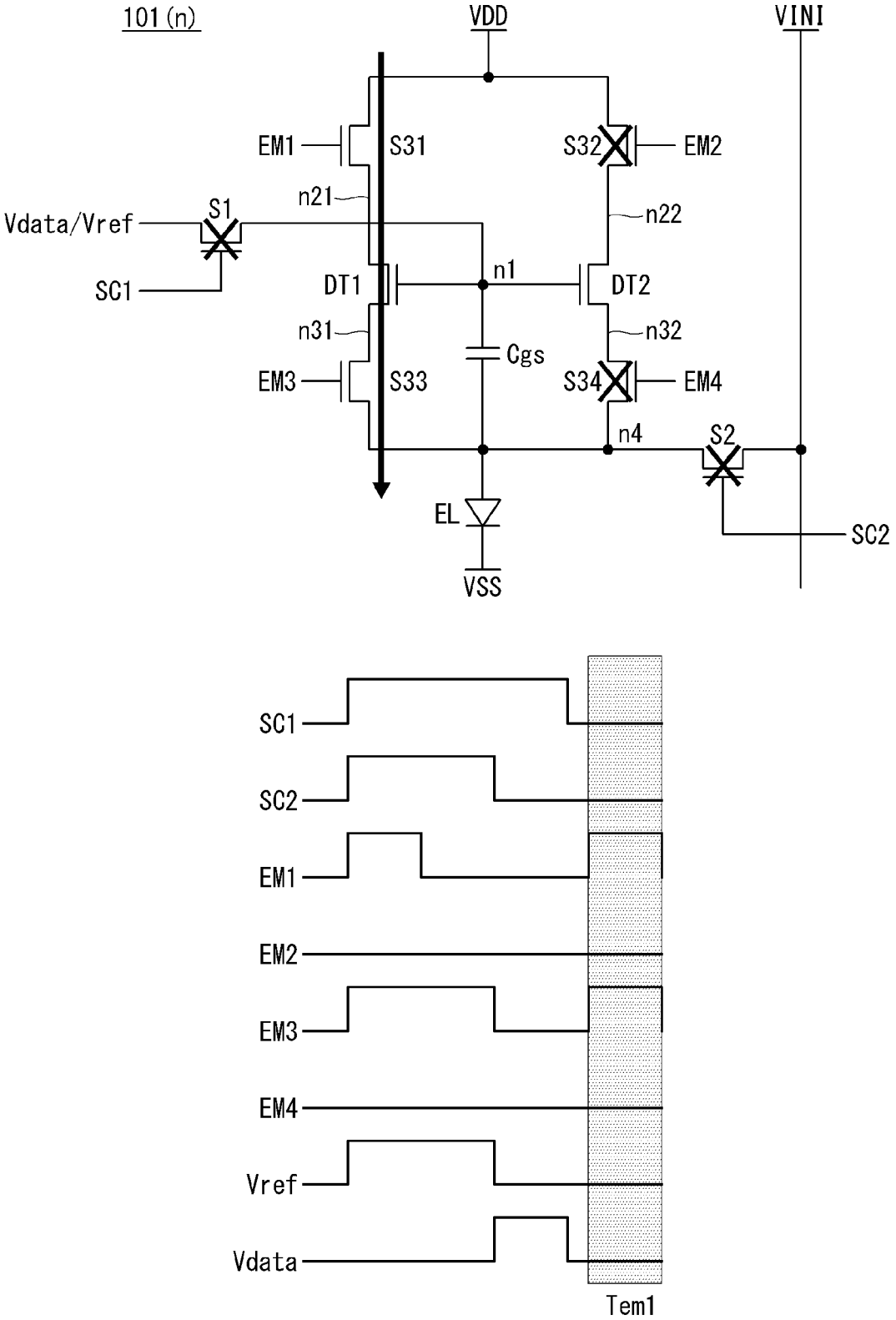

Referring to FIG. 16D, when a first emission time Tem1 starts, the first scan signal SC1 is inverted to the gate-off voltage, and the first and third EM signals EM1 and EM3 are inverted to the gate-on voltage. During the first emission time Tem1, the second scan signal SC2 is held at the gate-off voltage, and the second and fourth EM signals EM2 and EM4 are held at the gate-off voltage. Thus, during the first emission time Tem1, the (3-1)th and (3-3)th switching elements S31 and S33 are turned on, whereas the other switching elements S1, S2, S32, and S34 are turned off.

During the first emission time Tem1, current flows in the light-emitting element EL in response to the gate-source voltage Vgs of the first driving element DT1, thereby causing the light-emitting element EL to emit light. During the first emission time Tem1, the first EM signal EM1 may be generated as an alternating current signal that swings between the gate-on voltage and the gate-off voltage according to a preset PWM duty ratio (%). As the light-emitting element EL turns on and off repetitively according to a preset duty ratio during the first emission time Tem1, flicker and ghost images may be reduced. The current of the light-emitting element EL in a saturated region of the first driving element DT1 is represented by Equation 1.

As shown in FIGS. 16A to 16D, the first driver 101A drives the light-emitting element EL after compensating for the threshold voltage Vth of the first driving element DT1 in real time. In this case, no current flows in the second driver 101B, which prevents cumulative stress on the second driving element DT2 and achieves degradation recovery. The first driver 101A does not operate during operation of the second driver 101B shown in FIGS. 17A to 17D.

Figure 17A:
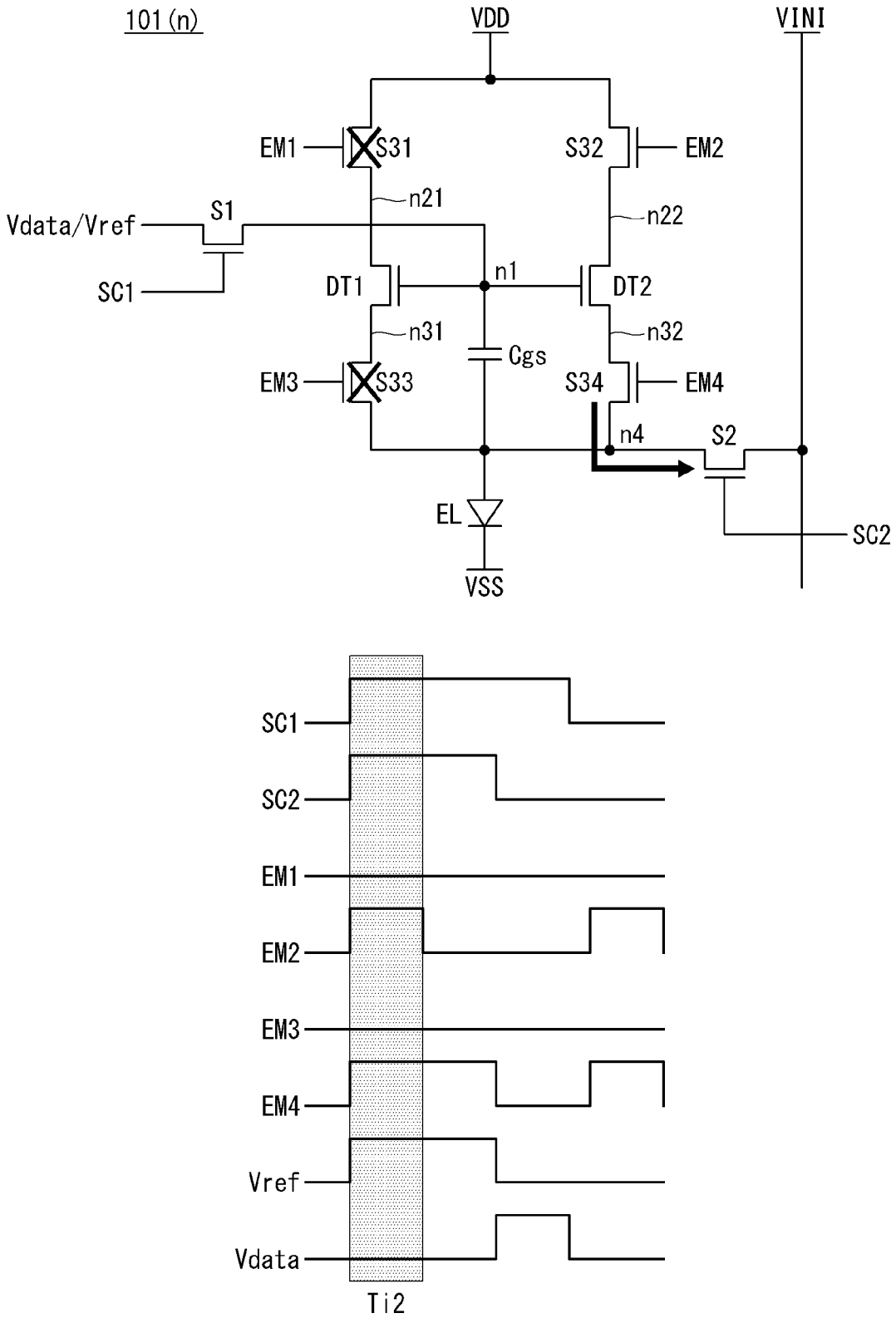

Referring to FIG. 17A, the first and second scan signals SC1 and SC2 and the second and fourth EM signals EM2 and EM4 change into the gate-on voltage when the second reset time Ti2 starts. The first and third EM signals EM1 and EM3 are held at the gate-off voltage during operation of the second driver 101B. Thus, the switching elements S1, S2, S32, and S34, other than the (3-1)th and (3-3)th switching elements S31 and S33, are turned on during the second reset time Ti2.

During the second reset time Ti2, Vref is supplied to the data lines 102. During the second reset time Ti2, the first switching element S1 turns on in response to the gate-on voltage of the first scan signal SC1, and the second switching element S2 turns on in response to the gate-on voltage of the second scan signal SC2. The (3-2)th switching element S32 turns on in response to the gate-on voltage of the second EM signal EM2. The (3-4)th switching element S34 turns on in response to the gate-on voltage of the fourth EM signal EM4.

The voltage of each node in the pixel circuit is reset during the second reset time Ti2. During the second reset time Ti2, the first node n1 is reset to Vref, the (2-2)th node n22 is reset to VDD, and the fourth node n4 is reset to VINI.

Figure 17B:
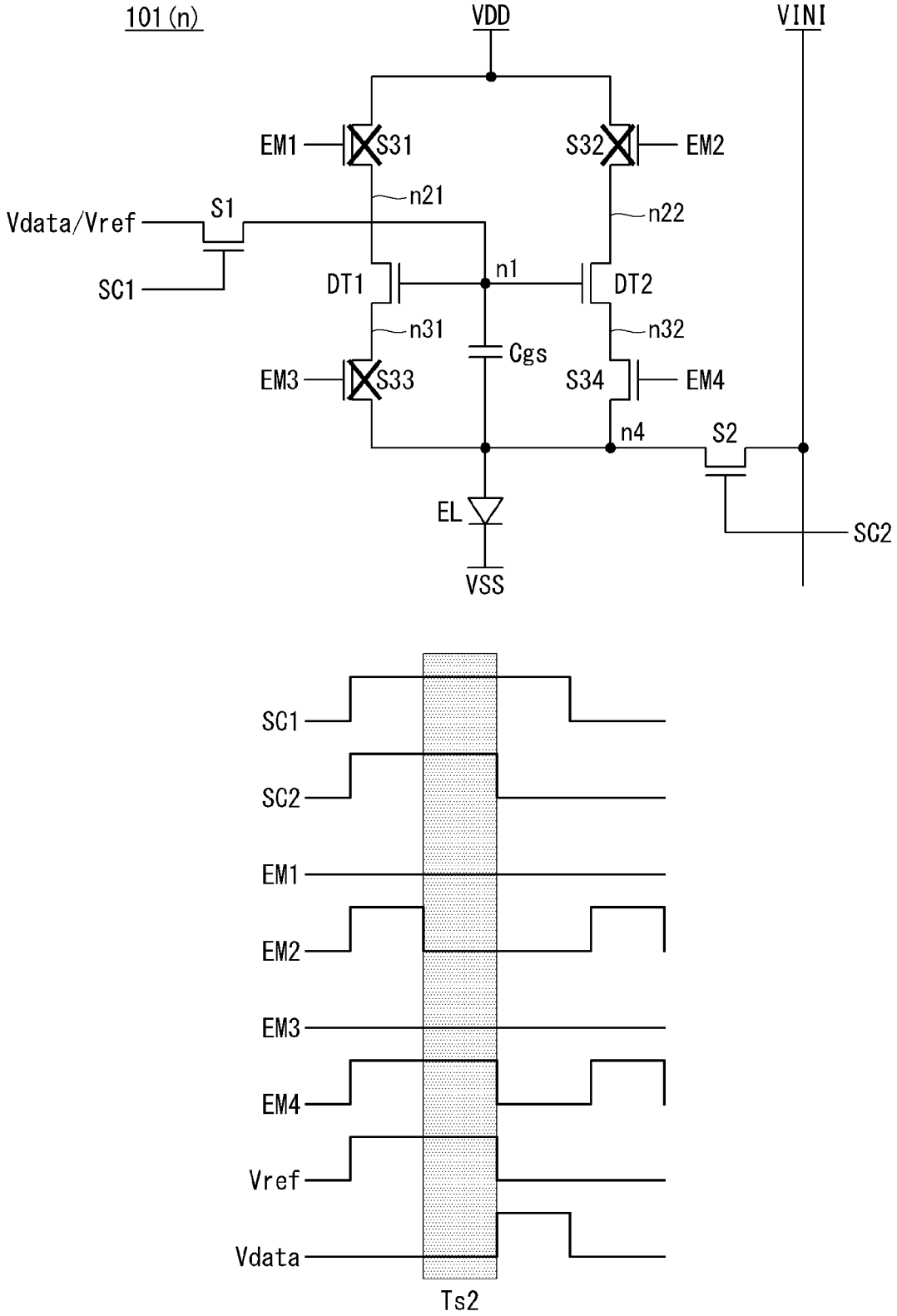

Referring to FIG. 17B, when a second sampling time Ts2 starts, the second EM signal EM2 is inverted to the gate-off voltage to turn off the (3-2)th switching element S32. During the second sampling time Ts2, the fourth EM signal EM4 and the first and second scan signals SC1 and SC2 are held at the gate-on voltage, and the first and third EM signals EM1 and EM3 are held at the gate-off voltage. Thus, during the second sampling time Ts2, the (3-1)th, (3-2)th, and (3-3)th switching elements S31, S32, and S33 are turned off, whereas the first and second switching elements S1 and S2 are turned on.

During the second sampling time Ts2, Vref is supplied to the data lines 102, and the voltage of the third node n3 is held at VINI. During the second sampling time Ts2, the gate-source voltage Vgs of the second driving element DT2 becomes higher by the threshold voltage Vth, and this threshold voltage Vth is stored in the storage capacitor Cgs.

Figure 17C:
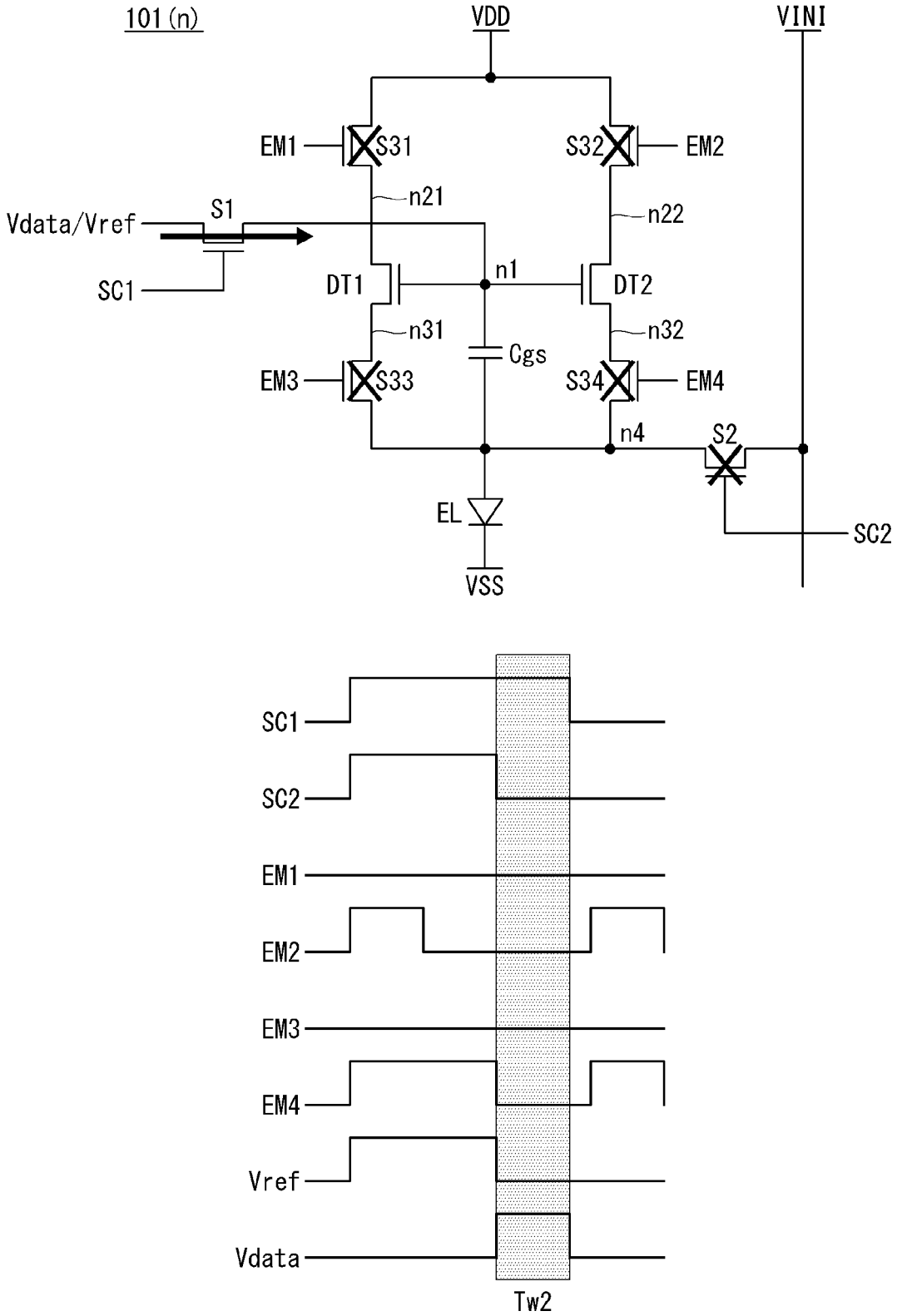

Referring to FIG. 17C, when a second data writing time Tw2 starts, the second scan signal SC2 and the fourth EM signal EM4 are inverted to the gate-off voltage. During the second data writing time Tw2, the first scan signal SC1 is held at the gate-on voltage, and the first, second, and third EM signals EM1, EM2, and EM3 are held at the gate-off voltage. Thus, during the second data writing time Tw2, the first switching element S1 remains in the on state and supplies a data voltage Vdata to the first node n1, whereas the other switching elements S2 and S31 to S34 are turned off.

In the second data writing time Tw2, the gate-source voltage Vgs of the second driving element DT2 changes into a data voltage offset by the threshold voltage Vth of the second driving element DT2.

Figure 17D:
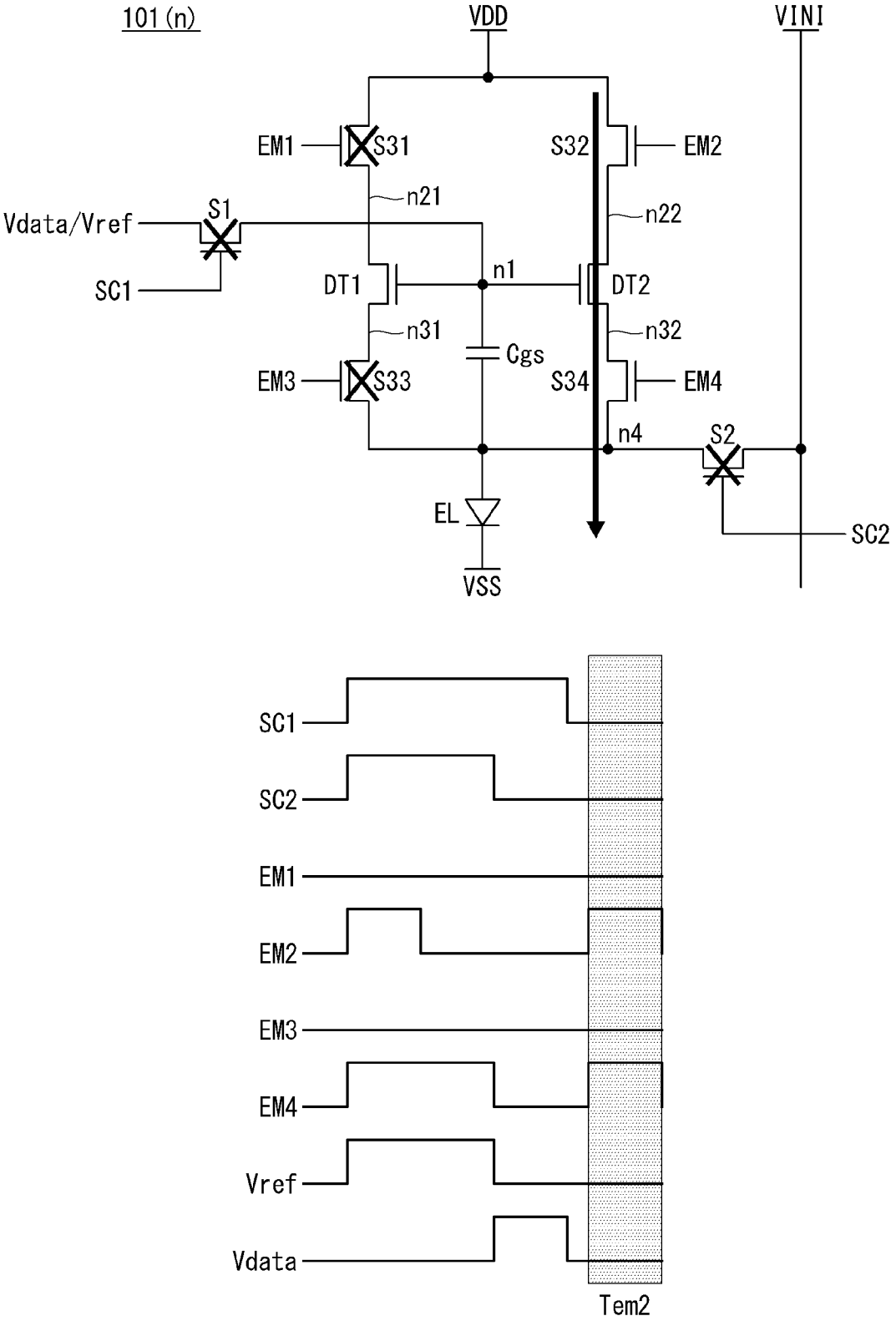

Referring to FIG. 17D, when a second emission time Tem2 starts, the first scan signal SC1 is inverted to the gate-off voltage, and the second and fourth EM signals EM2 and EM4 are inverted to the gate-on voltage. During the second emission time Tem2, the second scan signal SC2 is held at the gate-off voltage, and the first and third EM signals EM1 and EM3 are held at the gate-off voltage. Thus, during the second emission time Tem2, the (3-2)th and (3-4)th switching elements S32 and S34 are turned on, whereas the other switching elements S1, S2, S31, and S33 are turned off.

During the second emission time Tem2, current flows in the light-emitting element EL in response to the gate-source voltage Vgs of the second driving element DT2, thereby causing the light-emitting element EL to emit light. During the second emission time Tem2, the second EM signal EM2 may be generated as an alternating current signal according to a preset PWM duty ratio (%). As the light-emitting element EL turns on and off repetitively according to a preset duty ratio during the second emission time Tem2, flicker and ghost images may be reduced.

As shown in FIGS. 17A to 17D, the second driver 101B drives the light-emitting element EL after compensating for the threshold voltage Vth of the second driving element DT2 in real time. In this case, no current flows in the first driver 101A, which prevents cumulative stress on the first driving element DT1 and achieves degradation recovery.

In the foregoing exemplary aspects, the first switching element S1 sequentially supplies the reference voltage Vref and data voltage Vdata, received through a single data line, to the first node n1. In the third exemplary aspect of the present disclosure, the data voltage Vdata and the reference voltage Vref are supplied separately, as shown in FIGS. 18A to 19D.

FIGS. 18A to 18D and FIGS. 19A to 19D are schematic views showing a pixel circuit according to a third exemplary aspect of the present disclosure.

Referring to FIGS. 18A to 18D and FIGS. 19A to 19D, the pixel circuit comprises first and second driving elements DT1 and DT2 connected to a single light-emitting element EL, first to (3-2)th switching elements S11 to S32, and a storage capacitor Cgs.

The pixel circuit of the disclosure comprises first and second drivers that are operated alternately. The first driver 101A comprises the (3-1)th switching element S31 and the first driving element DT1, and is operated to supply an electrical current to the light-emitting element EL upon receiving a first EM signal EM1. The second driver 101B comprises the (3-2)th switching element S32 and the second driving element DT2, and is operated to supply an electrical current to the light-emitting element EL in response to a second EM signal EM2.

The present disclosure can reduce cumulative stress on the driving elements DT1 and DT2 and induce the recovery of the driving elements DT1 and DT2 since the first electrodes, i.e., drains, of the driving elements DT1 and DT2 float alternately to shut off the current flowing between the drain and source of the driving elements DT1 and DT2. The present disclosure prevents variation in the brightness of the pixels and ghost images by offsetting data voltages Vdata by variation in the threshold voltage Vth of the driving elements DT1 and DT2 and alternately operating the driving elements DT1 and DT2.

The driving elements DT1 and DT2 and the switching elements S11 to S32 may be implemented as NMOS oxide TFTs with an oxide semiconductor pattern. The oxide TFTs can reduce power consumption because of the small leakage current produced in the off state of the TFTs, and provide higher anti-flicker functionality by preventing a decrease in pixel voltage caused by leakage current.

The light-emitting element EL may be implemented as an OLED. The OLED emits light by the current regulated by the driving elements DT1 and DT2, in response to a data voltage Vdata. The OLED comprises an organic compound layer situated between an anode and a cathode. The organic compound layer may consist of, but is not limited to, a hole injection layer (HIL), a hole transport layer (HTL), an emission layer (EML), an electron transport layer (ETL), and an electron injection layer (EIL). The anode of the OLED is connected to the driving elements DT1 and DT2 via a third node n3, and VSS is applied to the cathode of the OLED. The storage capacitor Cgs is connected between the gate and source of the driving elements DT1 and DT2 via a first node n1 and the third nodes n3.

The first and third switching elements S12 and S11 allow the data voltage path and reference voltage path connected to the pixel circuit to be separated from each other. By separating the data voltage path and the reference voltage path, the sampling time Ts1 and Ts2 during which the reference voltage is applied may be longer than 1 horizontal period—for example, as much as 2 horizontal periods. 1 horizontal period is the time required to write data to 1 pixel line of the display panel. 1 horizontal period is equal to one cycle of the horizontal synchronization signal Hsync and the data enable signal DE. Pixel lines LINE1 and LINE2 require separate data writing times so that data is written to the pixel lines of the display panel, separately. Since the sampling time can be defined separately from the data writing time by separating the data voltage path and reference voltage path of the pixel circuit from each other, high-resolution and fast display panels with a short horizontal period may provide sufficient sampling time Ts1 and Ts2. On the other hand, if the data voltage Vdata and the reference voltage Vref are supplied in time-division manner to the pixel circuit through a single data line, the sampling time Ts1 and Ts2 and the data writing time Tw1 and Tw2 are separate within 1 horizontal period, which may lead to insufficient sampling time, especially for high-resolution and fast display panels.

This pixel circuit may sense the threshold voltage of the third switching element S11 in a sensing mode, while the first and third switching elements S12 and S11, which allow the data voltage path and the reference voltage path to be separated from each other, are turned on.

In response to a third scan signal SC3, the third switching element S11 supplies a data voltage Vdata of an input image to the first node n1 during the data writing times Tw1 and Tw2. The third switching element S11 comprises a gate connected to a (1-1)th gate line to which the third scan signal SC3 is applied, a first electrode connected to a data line 1021, and a second electrode connected to the first node n1.

In response to a first scan signal SC1, the first switching element S12 supplies Vref to the first node n1 during a reset time Ti1 and Ti2 and a sampling time Ts1 and Ts2. Vref is set to a voltage lower than VDD, for example, Vref1 of FIG. 21, in normal driving mode and low power consumption driving mode in which an input image is displayed on the screen. In sensing mode, Vref may be set to a sufficiently high voltage—for example, Vref2 of FIG. 21—in order to supply an electrical current to the current path comprising the first and third switching elements S12 and S11. The first switching element S12 comprises a gate connected to a (1-2)th gate line to which the first scan signal SC1 is applied, a first electrode connected to a reference voltage line 1022, and a second electrode connected to the first node n1. Vref is supplied to the pixels via the reference voltage line 1022.

In response to a second scan signal SC2, the second switching element S2 supplies VINI to the pixel electrode (or anode) of the light-emitting element EL via the third node n3. VINI is set to a voltage at which the light-emitting element EL emits no light. VINI is lower than VDD. The second switching element S2 comprises a gate connected to a second gate line to which the second scan signal SC2 is applied, a first electrode connected to the second power supply line to which VINI is applied, and a second electrode connected to the third node n3.

In response to a first EM signal EM1, the (3-1)th switching element S31 switches the current path between the first power supply line, to which VDD is applied, and the first driving element DT1. The (3-1)th switching element S31 and (3-2)th switching element S32 are alternately turned on and off. Thus, the (3-1)th switching element S31 is turned on during the off time of the (3-2)th switching element S32 to form a current path between the first power supply line 21 and the first driving element DT1. The (3-1)th switching element S31 comprises a gate connected to a (3-1)th gate line to which the first EM signal EM1 is applied, a first electrode connected to the first power supply line via a (2-1)th node n21, and a second electrode connected to the first electrode of the first driving element DT1.

The first driving element DT1 regulates the current of the light-emitting element EL in response to a gate-source voltage Vgs. The first driving element DT1 and the second driving element DT2 alternately drive the light-emitting element EL. The first driving element DT1 comprises a gate connected to the first node n1, a first electrode connected to the (2-1)th node n21, and a second electrode connected to the third node n3.

In response to a second EM signal EM2, the (3-2)th switching element S32 switches the current path between the first power supply line, to which VDD is applied, and the second driving element DT2. The (3-2)th switching element S32 is turned on during the off time of the (3-1)th switching element S31 to form a current path between the first power supply line and the second driving element DT2. The (3-2)th switching element S32 comprises a gate connected to a (3-2)th gate line to which the second EM signal EM2 is applied, a first electrode connected to the first power supply line via a (2-2)th node n22, and a second electrode connected to the first electrode of the second driving element DT2 via the (2-2)th node n22.

The second driving element DT2 regulates the current of the light-emitting element EL in response to a gate-source voltage Vgs. The second driving element DT2 and the first driving element DT1 alternately drive the light-emitting element EL. The second driving element DT2 comprises a gate connected to the first node n1, a first electrode connected to the (2-2)th node n22, and a second electrode connected to the third node n3.

Figure 18A:
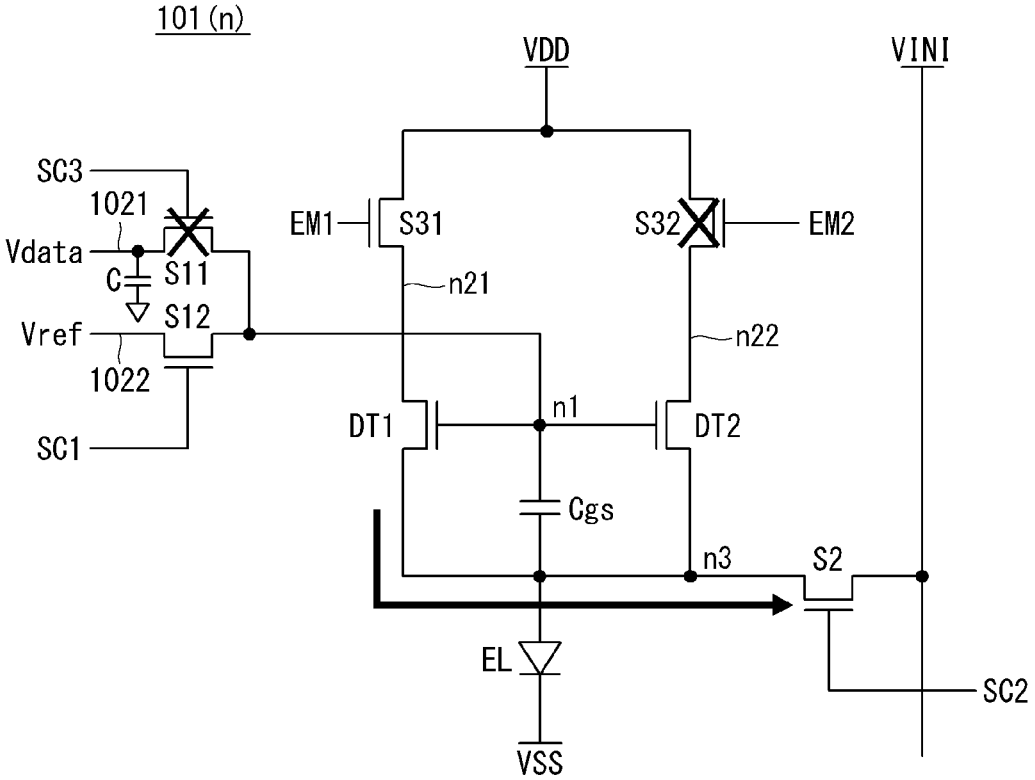
FIGS. 18A to 18D and FIGS. 19A to 19D are schematic views showing a pixel circuit according to a third exemplary aspect of the present disclosure.
Figure 18A:
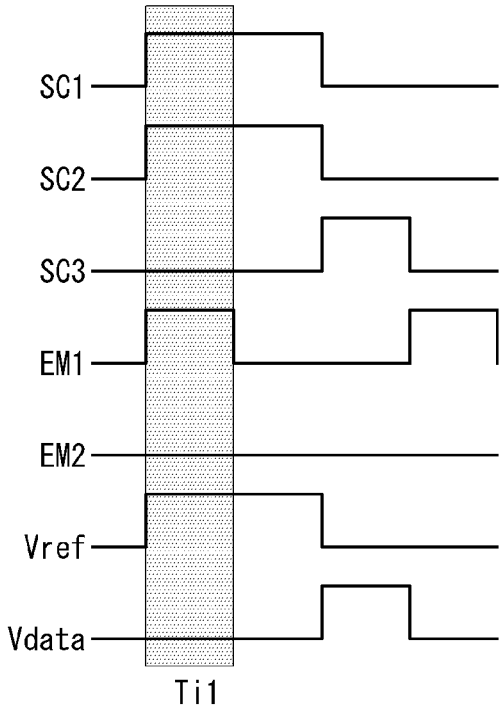

Referring to FIG. 18A, the first and second scan signals SC1 and SC2 and the first EM signal EM1 change into the gate-on voltage when a first reset time Ti1 starts. The second EM signal EM2 is held at the gate-off voltage during operation of the first driver 101A. The third scan signal SC3 is set to the gate-off voltage during the first reset time Ti1. In NMOS, the gate-on voltage is set to VGH, and the gate-off voltage is set to VGL. Thus, the switching elements S12, S2, and S31, other than the third and (3-2)th switching elements S11 and S32, are turned on during the first reset time Ti1.

The voltage of each node in the pixel circuit is reset during the first reset time Ti1. During the first reset time Ti1, the first node n1 is reset to Vref, the (2-1)th node n21 is reset to VDD, and the third node n3 is reset to VINI.

Figure 18B:
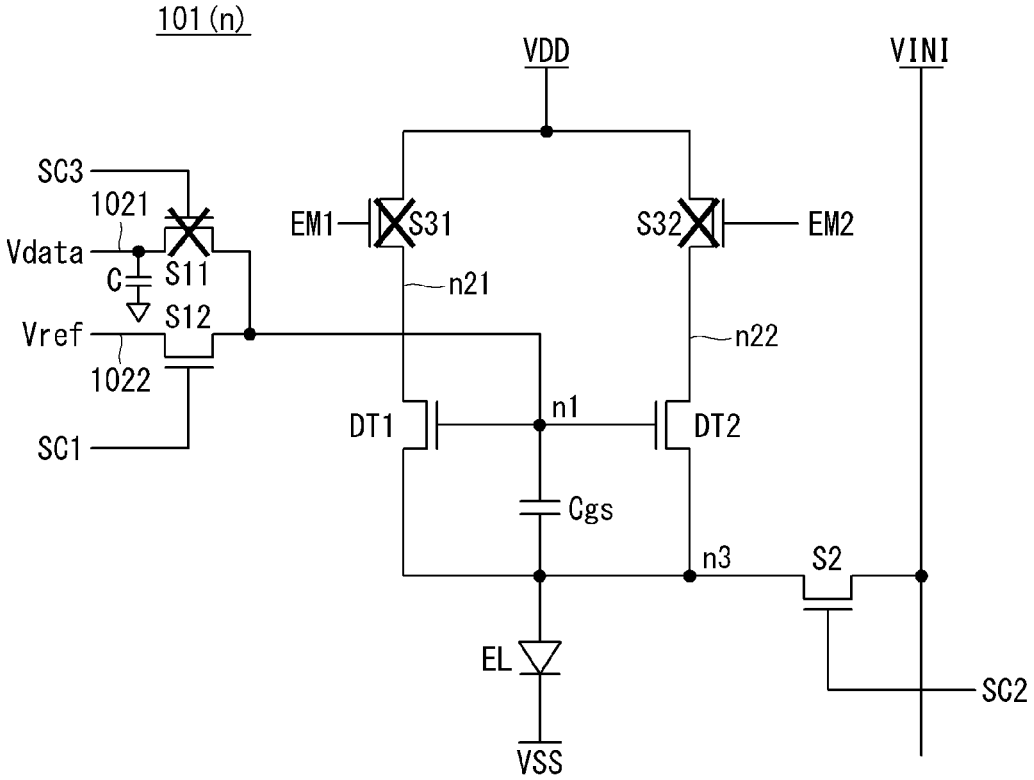
Figure 18B:
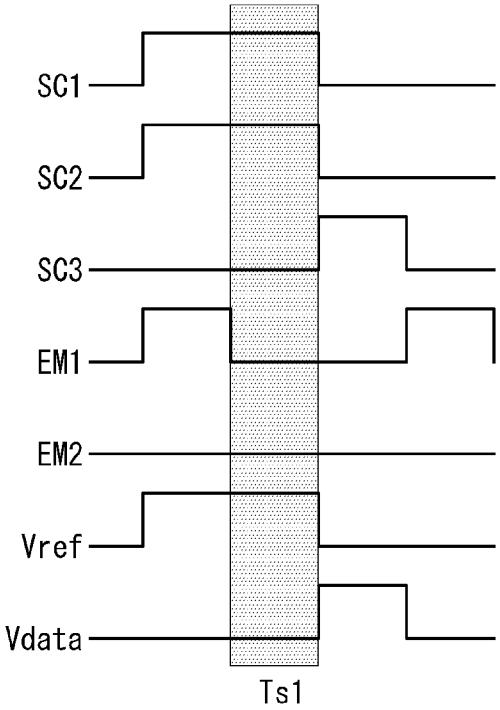

Referring to FIG. 18B, when a first sampling time Ts1 starts, the first EM signal EM1 is inverted to the gate-off voltage to turn off the (3-1)th switching element S31. During the first sampling time Ts1, the first and second scan signals SC1 and SC2 are held at the gate-on voltage, and the third scan signal SC3 and the second EM signal EM2 are held at the gate-off voltage. Thus, during the first sampling time Ts1, the third switching element S11 and the (3-1)th and (3-2)th switching elements S31 and S32 are turned off, whereas the first and second switching elements S12 and S2 are turned on.

During the first sampling time Ts1, the gate-source voltage Vgs of the first driving element DT1 becomes higher by the threshold voltage Vth of the first driving element DT1, and this threshold voltage Vth is stored in the storage capacitor Cgs.

Figure 18C:
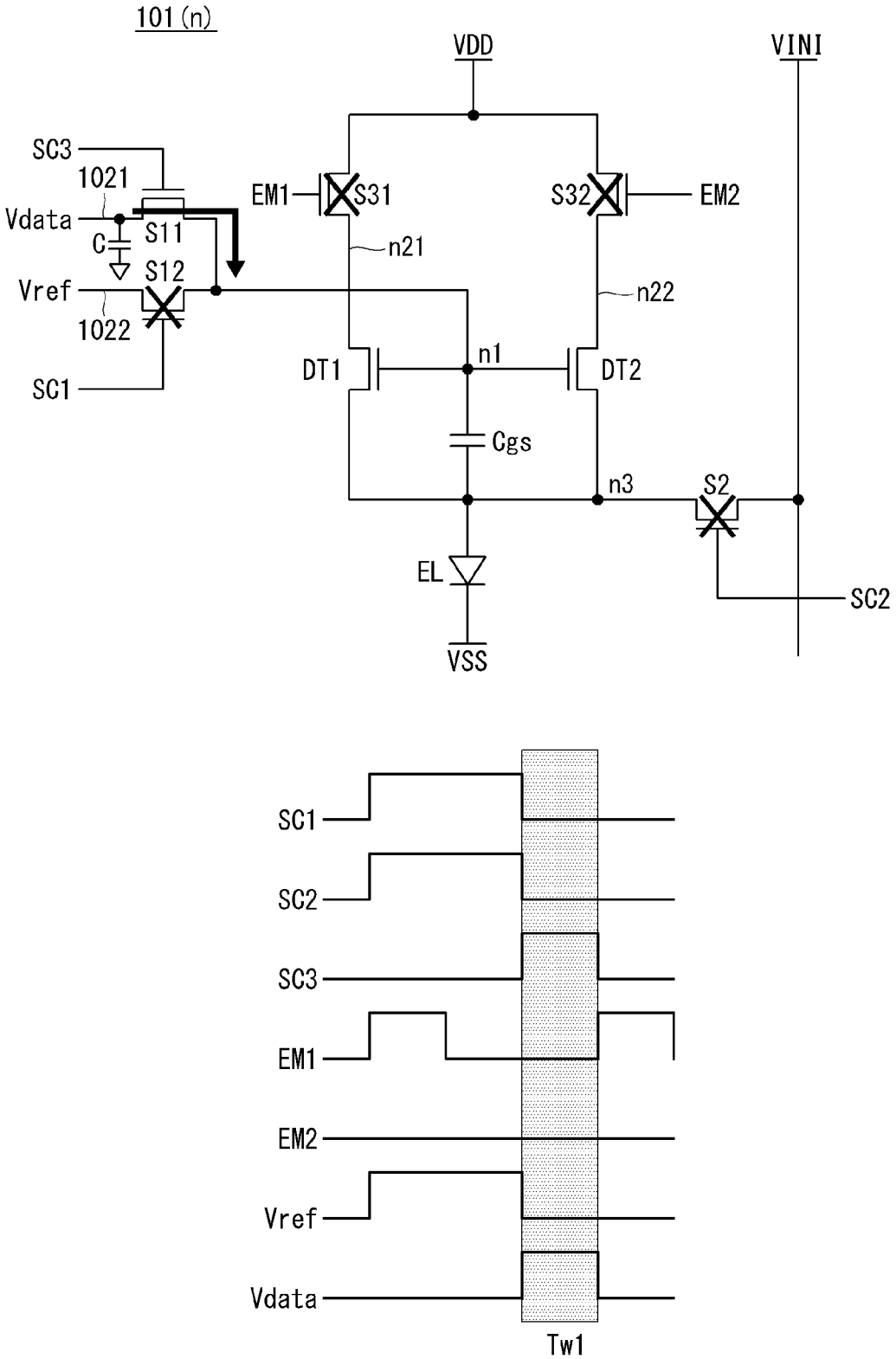

Referring to FIG. 18C, when a first data writing time Tw1 starts, the first and second scan signals SC1 and SC2 are inverted to the gate-off voltage, whereas the third scan signal SC3 is inverted to the gate-on voltage. During the first data writing time Tw1, the first and second EM signals EM1 and EM2 are held at the gate-off voltage. Thus, during the first data writing time Tw1, the third switching element S11 is turned on to supply a data voltage Vdata to the first node n1, whereas the other switching elements S12, S2, S31, and S32 are turned off.

In the first data writing time Tw1, the gate-source voltage Vgs of the first driving element DT1 changes into a data voltage offset by the threshold voltage Vth of the first driving element DT1.

Figure 18D:
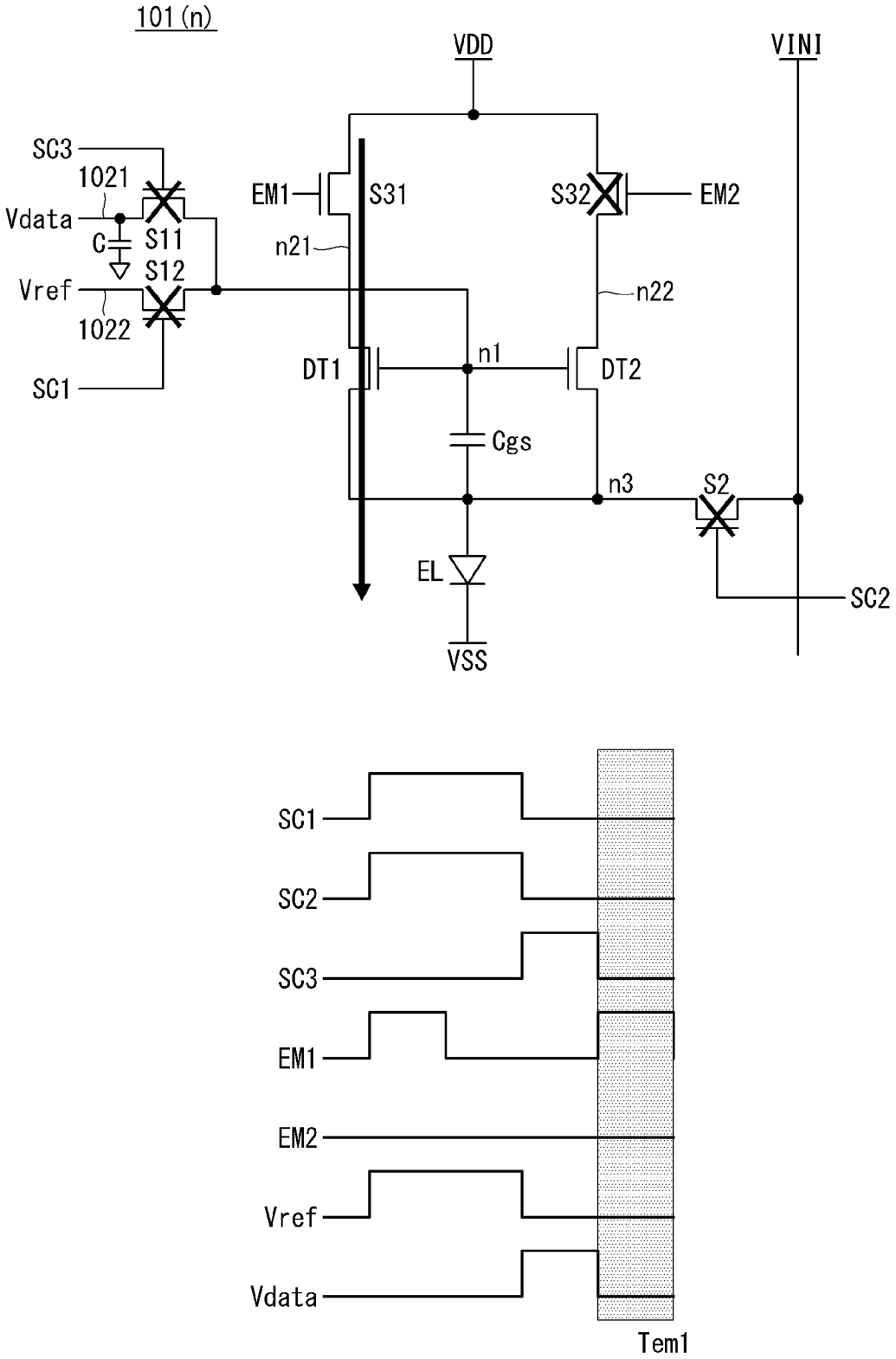

Referring to FIG. 18D, when a first emission time Tem1 starts, the third scan signal SC3 is inverted to the gate-off voltage, and the first EM signal EM1 is inverted to the gate-on voltage. During the first emission time Tem1, the second EM signal EM2 and the first and second scan signals SC1 and SC2 are held at the gate-off voltage. Thus, during the first emission time Tem1, the (3-1)th switching element S31 is turned on, whereas the other switching elements S11, S12, S2, and S32 are turned off.

During the first emission time Tem1, current flows in the light-emitting element EL in response to the gate-source voltage Vgs of the first driving element DT1, thereby causing the light-emitting element EL to emit light. During the first emission time Tem1, the first EM signal EM1 may be generated as an alternating current signal that swings between the gate-on voltage and the gate-off voltage according to a preset PWM duty ratio (%).

As shown in FIGS. 18A to 18D, the first driver drives the light-emitting element EL after compensating for the threshold voltage Vth of the first driving element DT1 in real time. In this case, no current flows in the second driver, which prevents cumulative stress on the second driving element DT2 and achieves degradation recovery. The first driver does not operate during operation of the second driver shown in FIGS. 19A to 19D.

Figure 19A:
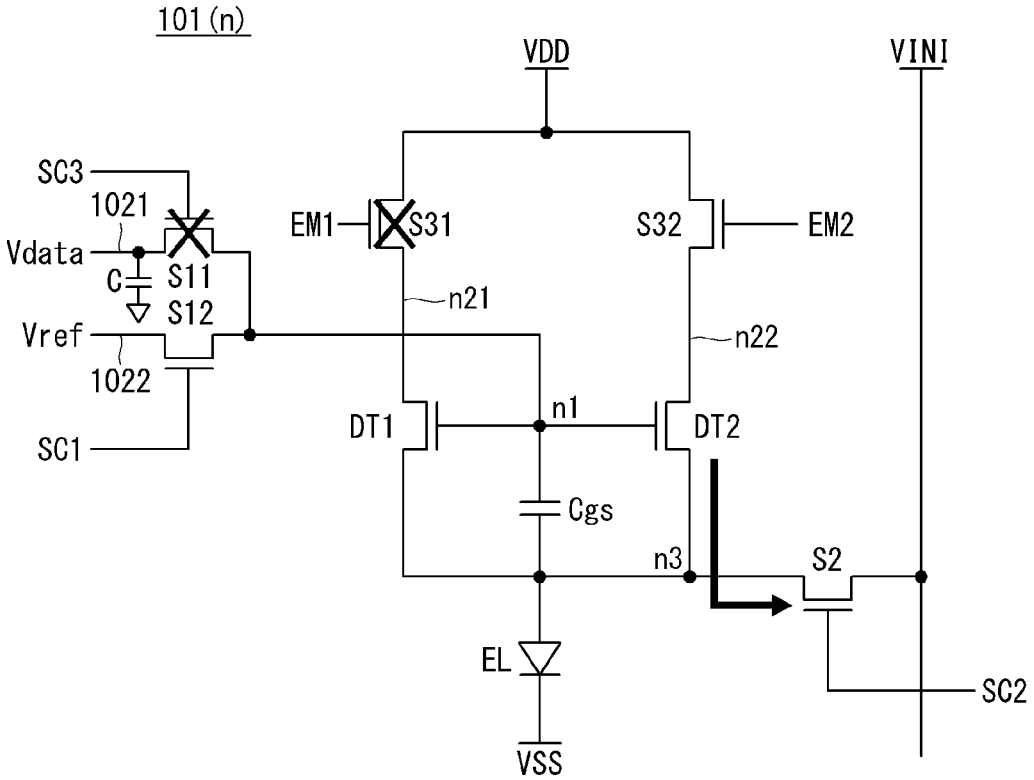
Figure 19A:
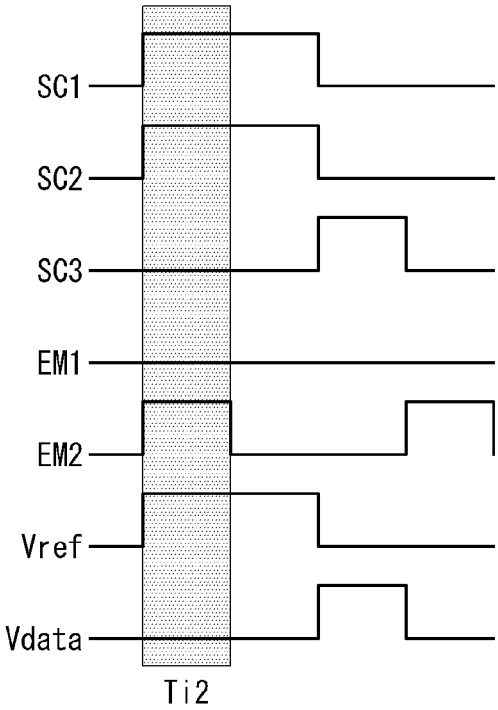

Referring to FIG. 19A, the first and second scan signals SC1 and SC2 and the second EM signal EM2 change into the gate-on voltage when the second reset time Ti2 starts. The first EM signal EM1 is held at the gate-off voltage during operation of the second driver. The third scan signal SC3 is set to the gate-off voltage during the second reset time Ti2. Thus, the switching elements S12, S2, and S32, other than the third and (3-1)th switching elements S11 and S31, are turned on during the second reset time Ti2.

The voltage of each node in the pixel circuit is reset during the second reset time Ti2. During the second reset time Ti2, the first node n1 is reset to Vref, the (2-1)th node n21 is reset to VDD, and the third node n3 is reset to VINI.

Figure 19B:
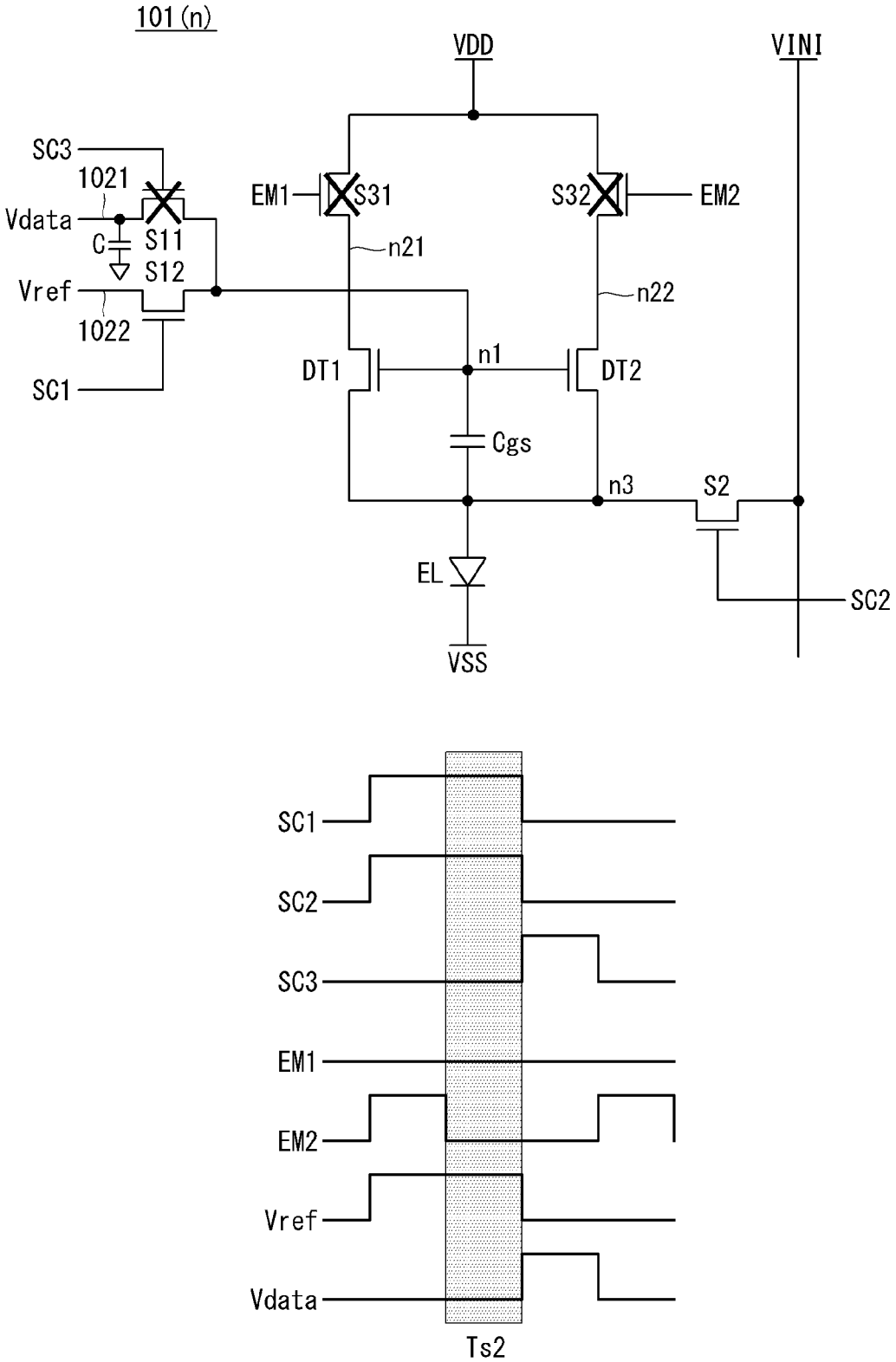

Referring to FIG. 19B, when a second sampling time Ts2 starts, the second EM signal EM2 is inverted to the gate-off voltage to turn off the (3-2)th switching element S32. During the second sampling time Ts2, the first and second scan signals SC1 and SC2 are held at the gate-on voltage, and the third scan signal SC3 and the first EM signal EM1 are held at the gate-off voltage. Thus, during the second sampling time Ts2, the third switching element S11 and the (3-1)th and (3-2)th switching elements S31 and S32 are turned off, whereas the first and second switching elements S12 and S2 are turned on.

During the second sampling time Ts2, the gate-source voltage Vgs of the second driving element DT2 becomes higher by the threshold voltage Vth, and this threshold voltage Vth is stored in the storage capacitor Cgs.

Figure 19C:
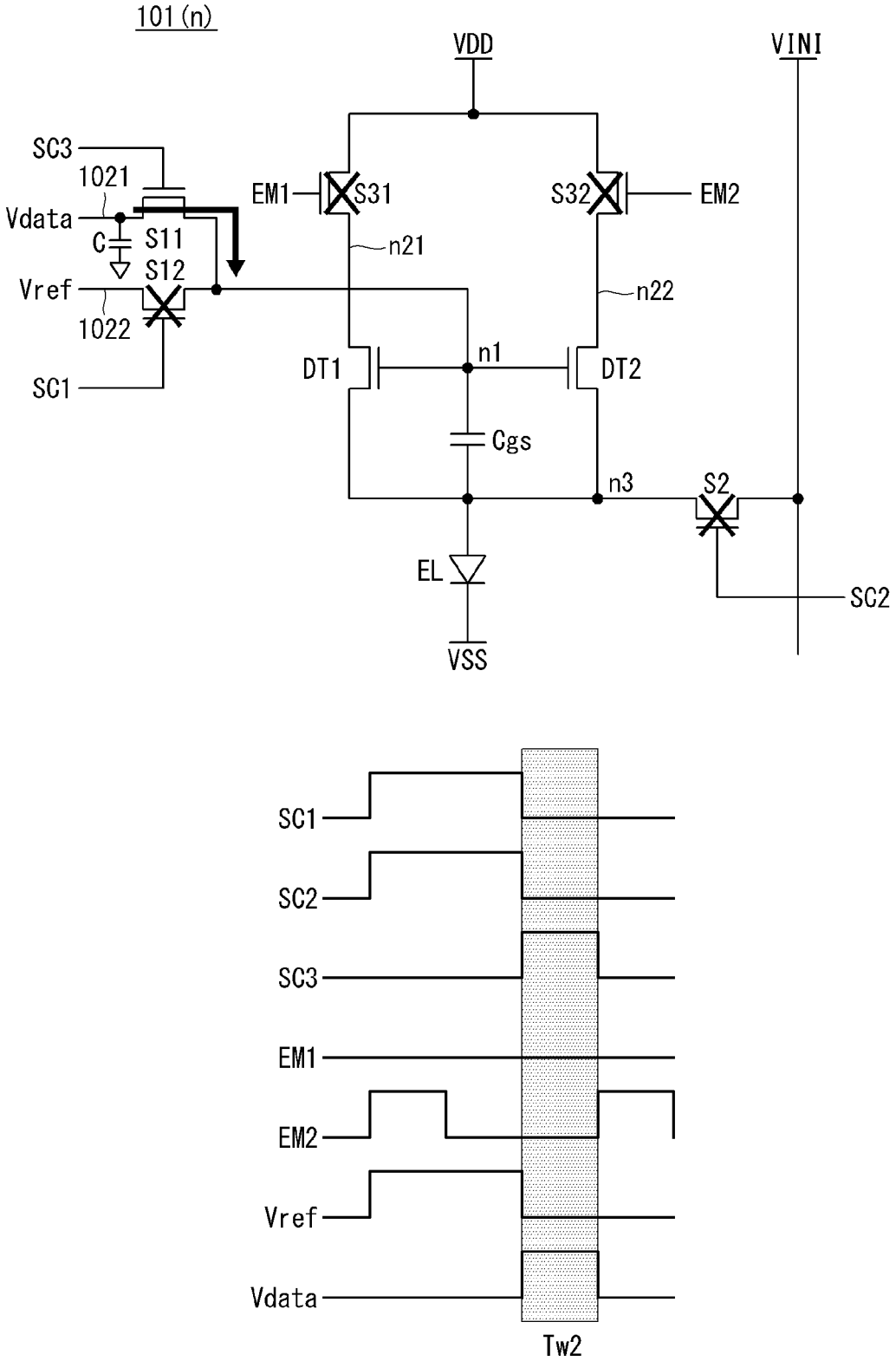

Referring to FIG. 19C, when a second data writing time Tw2 starts, the first and second scan signals SC1 and SC2 are inverted to the gate-off voltage, whereas the third scan signal SC3 is inverted to the gate-on voltage. During the second data writing time Tw2, the first and second EM signals EM1 and EM2 are held at the gate-on voltage. Thus, during the second data writing time Tw2, the third switching element S11 is turned on to supply a data voltage Vdata to the first node n1, whereas the other switching elements S12, S2, S31, and S32 are turned off.

In the second data writing time Tw2, the gate-source voltage Vgs of the second driving element DT2 changes into a data voltage offset by the threshold voltage Vth of the second driving element DT2.

Figure 19D:
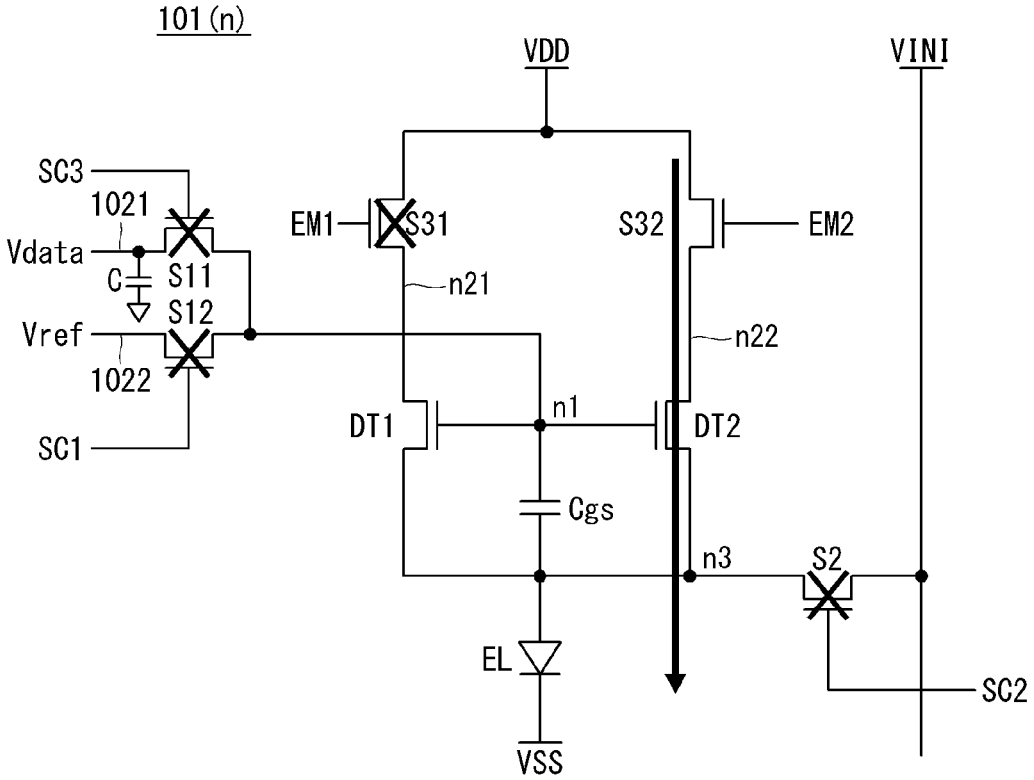
Figure 19D:
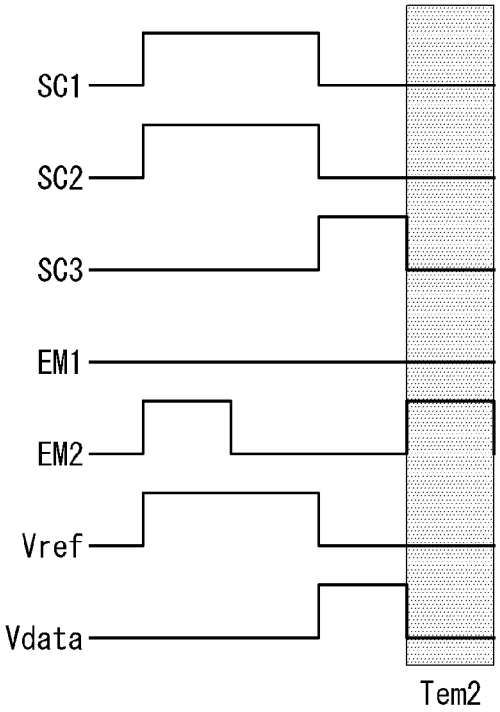

Referring to FIG. 19D, when a second emission time Tem2 starts, the third scan signal SC3 is inverted to the gate-off voltage, and the second EM signal EM2 is inverted to the gate-on voltage. During the second emission time Tem2, the first EM signal EM1 and the first and second scan signals SC1 and SC2 are held at the gate-off voltage. Thus, during the second emission time Tem2, the (3-2)th switching element S32 is turned on, whereas the other switching elements S11, S12, S2, and S31 are turned off.

During the second emission time Tem2, current flows in the light-emitting element EL in response to the gate-source voltage Vgs of the second driving element DT2, thereby causing the light-emitting element EL to emit light. During the second emission time Tem2, the second EM signal EM2 may be generated as an alternating current signal that swings between the gate-on voltage and the gate-off voltage according to a preset PWM duty ratio (%).

As shown in FIGS. 18A to 18D and FIGS. 19A to 19D, the sampling time Ts1 and Ts2 may be longer than 1 horizontal period since the data voltage path and reference voltage path connected to this pixel circuit are separated from each other. This pixel circuit allows for sensing the threshold voltage of the switching element S11 by using a current path via which the switching elements S11 and S12 on the data voltage path and reference voltage path are connected. Using this sensing method, the threshold voltage of a switching element may be easily sensed in a sensing mode, distinct from the process of sensing the threshold voltage of a driving element.

Figure 20:
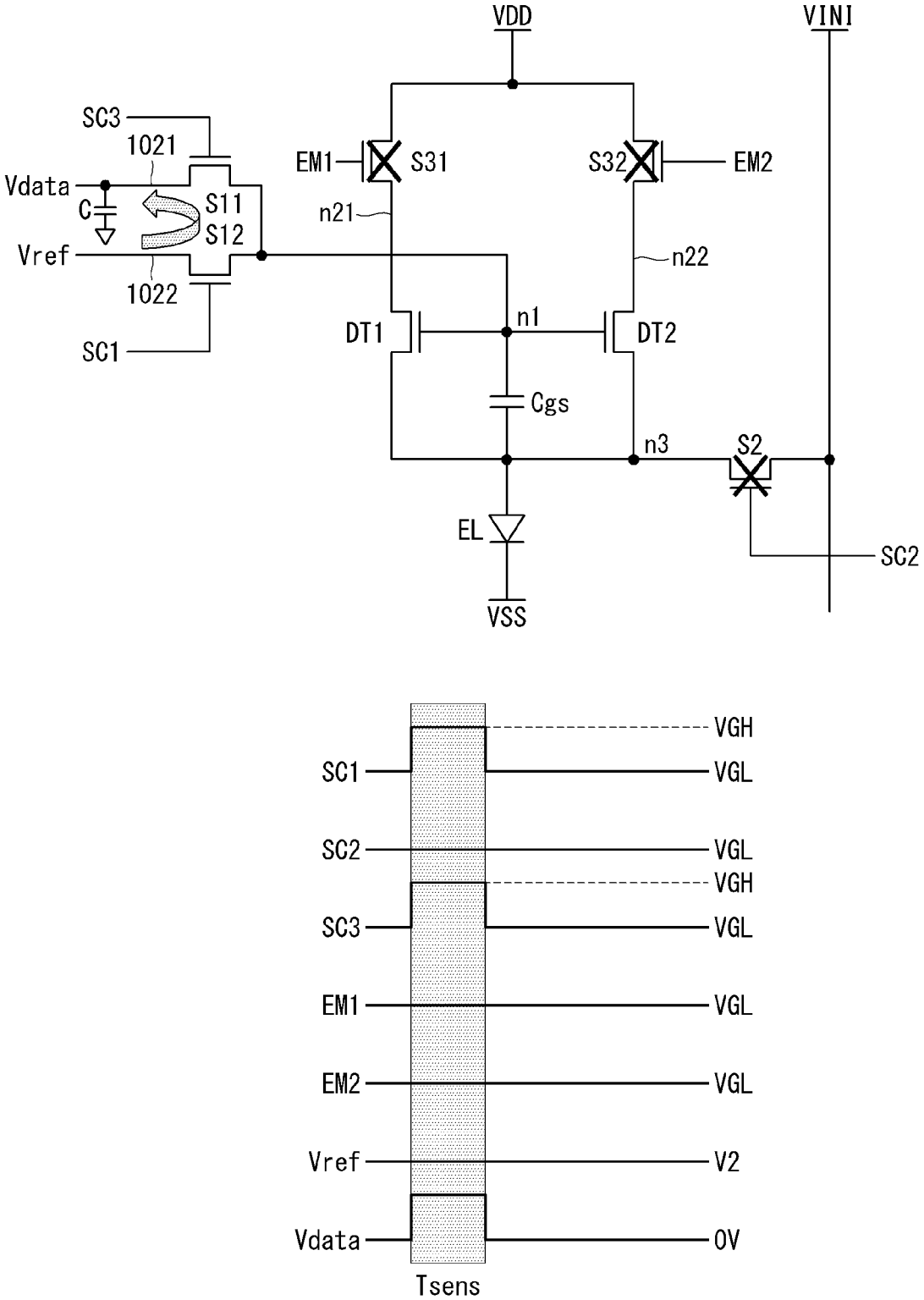
FIG. 20 is a view showing a method for sensing the threshold voltage of a switching element.
Figure 21:
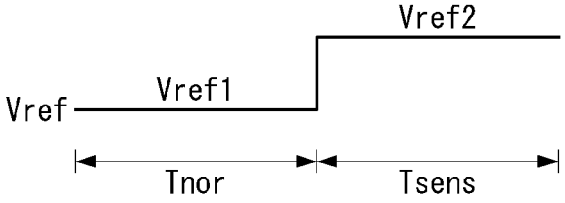
FIG. 21 is a view showing an example in which reference voltage rises in sensing mode.

FIGS. 20 and 21 are views showing a method for sensing the threshold voltage of a switching element in a sensing mode.

Referring to FIGS. 20 and 21, in sensing mode Tsens, the reference voltage Vref rises to VDD or a higher voltage Vref2. In normal driving mode Tnor or low power consumption driving mode in which an input image is displayed on the screen, the reference voltage Vref may be set to a low voltage Vref1 between −2 V and 2 V.

In sensing mode Tsens, the first and third scan signals SC1 and SC3 are generated at the gate-on voltage VGH. In sensing mode Tsens, the second scan signal SC2 and the EM signals EM1 and EM2 are held at the gate-off voltage VGL. Thus, in sensing mode Tsens, the first and third switching elements S12 and S11 may be turned on to form a current path in which current flows from the reference voltage line 1022 to the data line 1021.

In sensing mode Tsens, the voltage of the third scan signal SC3 is higher than Vref2, and the channel of the first switching element S12 is fully opened when the first switching element S12 is turned on. When the gate-source voltage of the third switching element S11 becomes equal to the threshold voltage, the third switching element S11 is turned off. By comparing the voltage stored in the data line 1021—i.e., the voltage stored at the parasitic capacitance C of the data line 1021—to Vref2, the threshold voltage of the third switching element S11 may be detected. In sensing mode Tsens, the differential voltage between the voltage of the data line 1022 and Vref2 corresponds to the threshold voltage of the third switching element S11. Accordingly, in sensing mode Tsens, the threshold voltage of the third switching element S11 may be sensed as the differential voltage between the voltage of the data line 1022 and Vref2.

In the pixel circuit according to the third exemplary aspect, shown in FIGS. 18A to 18D, FIGS. 19A to 19D, and FIGS. 20 to 21, the switching element S1 of the pixel circuit of FIG. 2, FIGS. 3A to 3D and FIGS. 4A to 4D is divided into the first and third switching elements S12 and S11. The switching elements S11 and S12 of FIGS. 18A to 21 may substitute for the switching element S1 of the pixel circuit (of FIGS. 14 to 15, FIGS. 16A to 16D and FIGS. 17A to 17D) according to the second exemplary aspect.

As discussed above, in the present disclosure, when the light-emitting element is driven, the threshold voltage of two driving elements is compensated for by using a pixel circuit comprising an internal compensation circuit, and the driving elements are alternately operated, thereby reducing cumulative stress and ensuring sufficient time for recovering the electrical characteristics of the driving elements. In the present disclosure, in low power consumption driving mode, the frame rate is decreased, and the driving element with a lower channel-width-to-length ratio is operated. Accordingly, the present disclosure prevents ghost images caused by cumulative stress on the driving elements in the electroluminescence display and reduces power consumption.

The present disclosure provides the same brightness in normal driving mode and low power consumption driving mode by controlling the pixel driving voltage applied to driving elements with different channel width-to-length ratios.

The present disclosure allows driving elements in high-resolution and fast display panels to have sufficient sampling time by separating the data voltage path and reference voltage path connected to the pixel circuit, and allows for sensing the threshold voltage of switching elements on the data voltage path and reference voltage path by using a current path via which the switching elements are connected.

Although aspects have been described with reference to a number of illustrative aspects thereof, it should be understood that numerous other modifications and aspects can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electroluminescence display including a plurality of data lines and a plurality of gate lines intersecting each other and a plurality of pixels arranged in a matrix form having a plurality of subpixels, each subpixel comprising:

a first driver configured to drive a light-emitting element by using a first light-emission control (EM) switching element, which switches a current path between a power supply line to which a pixel driving voltage is applied and the light-emitting element in response to a first light-emission control signal, and a first driving element connected between the first EM switching element and the light-emitting element; and a second driver configured to drive the light-emitting element by using a second EM switching element, which switches the current path between the power supply line and the light-emitting element in response to a second light-emission control signal, and a second driving element connected between the second EM switching element and the light-emitting element, wherein the first and second drivers are electrically connected to each other, wherein the first and second drivers are operated alternately in a normal driving mode and data is written to the pixels in the normal driving mode in every frame, and wherein the first and second driving elements share a single gate.

2. The electroluminescence display of claim 1, wherein the driving elements and the first and second EM switching elements include oxide semiconductor transistors.

3. The electroluminescence display of claim 1, wherein the first and second driving elements are stacked vertically on a substrate, and one of the first and second driving elements is a top-gate transistor in which the gate is placed over a first semiconductor pattern and the other is a bottom-gate transistor in which the gate is placed under a second semiconductor pattern.

4. The electroluminescence display of claim 1, wherein the first and second driving elements include top-gate transistors sharing the single gate.

5. The electroluminescence display of claim 1, wherein the first and second driving elements include bottom-gate transistors sharing the single gate.

6. The electroluminescence display of claim 1, wherein the first EM signal is generated with a gate-on voltage during operation of the first driver in the normal driving mode to turn on the first EM switching element, and the second EM signal is generated with the gate-on voltage during operation of the second driver in the normal driving mode to turn on the second EM switching element.

7. The electroluminescence display of claim 1, wherein the first EM signal is generated with a gate-on voltage in a normal driving mode to operate the first driver, and the second EM signal is generated with the gate-on voltage in a low power consumption driving mode to operate the second driver, and data is written to the pixels in every frame in the normal driving mode, the frame rate at which data is written to the pixels in the low power consumption driving mode is lower than the frame rate in the normal driving mode.

8. The electroluminescence display of claim 1, wherein the first and second EM signals are generated with a gate-on voltage in a normal driving mode to alternately operate the first and second drivers, and the second EM signal is generated with the gate-on voltage in a low power consumption driving mode to operate the second driver, and data is written to the pixels in every frame in the normal driving mode, the frame rate at which data is written to the pixels in the low power consumption driving mode is lower than the frame rate in the normal driving mode.

9. The electroluminescence display of claim 8, wherein the second driving element has a channel width-to-length ratio (W/L) lower than a channel width-to-length ratio (W/L) of the first driving element.

10. The electroluminescence display of claim 8, wherein the pixel driving voltage applied to the second driver during operation of the second driver is lower than the pixel driving voltage applied to the first driver during operation of the first driver.

11. The electroluminescence display of claim 1, further comprising a storage capacitor connected between gates of the driving elements and the light-emitting element, wherein the first and second driving elements has a threshold voltage stored in the storage capacitor during a preset threshold voltage sampling time, and a data voltage is supplied to the gates of the driving elements during a data writing time following a threshold voltage sampling time.

12. The electroluminescence display of claim 1, wherein the first driver further comprises a third EM switching element that is located between the first driving element and the light-emitting element and switches the current path between the first driving element and the light-emitting element in response to a third light-emission control signal, and the second driver further comprises a fourth EM switching element that is located between the second driving element and the light-emitting element and switches the current path between the second driving element and the light-emitting element in response to a fourth light-emission control signal.

13. The electroluminescence display of claim 1, further comprising:

a first switching element that supplies a predetermined reference voltage to gates of the first and second driving elements during a reset time and a sampling time following the reset time and then supplies a data voltage to the gates of the first and second driving elements during a data writing time following the sampling time, in response to a first scan signal; and a second switching element that supplies a predetermined initial voltage to an anode of the light-emitting element and source electrodes of the first and second driving elements during the reset time, in response to a second scan signal.

14. The electroluminescence display of claim 1, further comprising:

a first switching element that supplies a predetermined reference voltage to gates of the first and second driving elements during a reset time and a sampling time following the reset time, in response to a first scan signal;

a second switching element that supplies a predetermined initial voltage to an anode of the light-emitting element and source electrodes of the first and second driving elements during the reset time, in response to a second scan signal; and a third switching element that supplies a data voltage to the gates of the first and second driving elements during a data writing time following the sampling time, in response to a third scan signal.

15. The electroluminescence display of claim 14, wherein the first and third scan signals are simultaneously generated with a gate-on voltage in a sensing mode to simultaneously turn on the first and third switching elements, and a threshold voltage of the third switching element is sensed via a current path comprising a reference voltage line to which the reference voltage is supplied, the first and third switching elements, and a data line to which the data voltage is supplied.

16. An electroluminescence display including a plurality of pixels, each pixel having a plurality of subpixels, each subpixel comprising:

a first driver driving a light-emitting element by using a first light-emission control (EM) switching element, which switches a current path between a pixel driving voltage and the light-emitting element in response to a first light-emission control signal, and a first driving element connected between the first EM switching element and the light-emitting element; and a second driver driving the light-emitting element by using a second EM switching element, which switches the current path between the pixel driving voltage and the light-emitting element in response to a second light-emission control signal, and a second driving element connected between the second EM switching element and the light-emitting element, wherein the first and second drivers are electrically connected to each other and are operated alternately in a normal driving mode and data is written to the plurality of pixels in the normal driving mode in every frame, and wherein the first and second driving elements share a single gate.

17. The electroluminescence display of claim 16, wherein the first EM signal is generated with a gate-on voltage during operation of the first driver in the normal driving mode to turn on the first EM switching element, and the second EM signal is generated with the gate-on voltage during operation of the second driver in the normal driving mode to turn on the second EM switching element.

18. The electroluminescence display of claim 16, wherein the first EM signal is generated with a gate-on voltage in the normal driving mode to operate the first driver, and the second EM signal is generated with the gate-on voltage in a low power consumption driving mode to operate the second driver, and data is written to the pixels in every frame in the normal driving mode, the frame rate at which data is written to the pixels in the low power consumption driving mode is lower than the frame rate in the normal driving mode.

* * * * *